US008905800B2

(12) United States Patent
Dusablon

(10) Patent No.: US 8,905,800 B2
(45) Date of Patent: Dec. 9, 2014

(54) INLET GRATE FOR A WATER JET PROPULSION SYSTEM

(71) Applicant: BRP US Inc., Sturtevant, WI (US)

(72) Inventor: Patrice Dusablon, Palm Bay, FL (US)

(73) Assignee: BRP US Inc., Sturtevant, WI (US)

( * ) Notice: Subject to any disclaimer, the term of this patent is extended or adjusted under 35 U.S.C. 154(b) by 0 days.

(21) Appl. No.: 13/945,195

(22) Filed: Jul. 18, 2013

(65) Prior Publication Data

US 2013/0309921 A1 Nov. 21, 2013

Related U.S. Application Data

(63) Continuation of application No. 12/551,259, filed on Aug. 31, 2009, now abandoned.

(51) Int. Cl.

| | |
|---|---|
| ***B63H 11/01*** | (2006.01) |
| ***B63B 35/73*** | (2006.01) |
| ***B63H 11/103*** | (2006.01) |

(52) U.S. Cl.

CPC ..... *B63H 11/01* (2013.01); *B63B 35/731* (2013.01); *B63H 11/103* (2013.01)

USPC ..... 440/46

(58) Field of Classification Search

CPC ..... B63H 11/01

USPC ..... D12/300; 60/221; 440/47, 46, 38

See application file for complete search history.

(56) References Cited

U.S. PATENT DOCUMENTS

| | | | |
|---|---|---|---|
| 5,114,368 | A | 5/1992 | Moyle et al. |
| 5,176,547 | A | 1/1993 | Kobayashi et al. |
| 5,540,605 | A | 7/1996 | Lin |
| 5,577,941 | A | 11/1996 | Chartier |
| 5,658,176 | A | 8/1997 | Jordan |
| 5,679,035 | A | 10/1997 | Jordan |
| 5,683,276 | A | 11/1997 | Jordan |
| 5,700,169 | A | 12/1997 | Jones |
| 5,846,105 | A | 12/1998 | Baker et al. |
| 5,876,258 | A | 3/1999 | Gray |
| 5,910,033 | A | 6/1999 | Norrstrand |
| 6,375,523 | B1 | 4/2002 | Mathias |
| 6,533,623 | B2 | 3/2003 | Simard et al. |
| 6,857,920 | B2 | 2/2005 | Marathe et al. |
| 6,872,105 | B2 | 3/2005 | Dusablon et al. |
| 7,241,193 | B2 | 7/2007 | Jordan |

(Continued)

OTHER PUBLICATIONS

Atlantic Jet Sports, Intake Grate [online], [retrieved on Sep. 6, 2009]. Retrieved from the Internet: < URL: http//www.atlanticjetsports.com/intakegrate_riva.htm>.

(Continued)

*Primary Examiner* — Edwin Swinehart

(74) *Attorney, Agent, or Firm* — BCF LLP

(57) ABSTRACT

An inlet grate for a water jet propulsion system to be used in a watercraft has a water passage having an inlet defined by a forward and a rearward area with respect to the watercraft. The inlet grate comprises a first end portion adapted to be connected to the forward area of the inlet and a second end portion adapted to be connected to the rearward area of the inlet as well as at least one elongated member extending from the first end portion toward the second end portion. The inlet grate also comprises at least one deflector having a forward end and a rearward end, the forward end being adjacent to the first end portion of the inlet grate.

20 Claims, 18 Drawing Sheets

(56) References Cited

U.S. PATENT DOCUMENTS

| | | | |
|---|---|---|---|
| 7,299,763 | B2 | 11/2007 | Loui et al. |
| 7,380,514 | B2 | 6/2008 | Loui et al. |
| 7,470,161 | B2 | 12/2008 | Loui et al. |
| 7,841,915 | B2 | 11/2010 | Bourret et al. |
| 2009/0130925 | A1 | 5/2009 | Burg |
| 2010/0022145 | A1 | 1/2010 | Dagenais et al. |
| 2011/0053440 | A1 | 3/2011 | Dusablon |

OTHER PUBLICATIONS

GP1200R Handling Modifications, Yamaha GP1200R [online]: Aquavien Pro Shoe/Grate 2002 [retrieved on Nov. 10, 2009]. Retrieved from the internet: < URL: http://www.hydrotoys.com/gpr/pump.htlm> pp. 4-5.

Inlet grate for Polaris SLH 2000, Water Inlet [online], [retrieved on Nov. 10, 2009]. Retrieved from the internet: < URL: http://www.partsland.com/index.cgi?N=1020044859-11327&P=PW-2000-SLH-WATER-INLET>.

Sea Doo RxP, The Gray Ghost [online]. R&D Grate 2004 [retrieved on Nov. 10, 2009]. Retrieved from the internet : < URL: http://www.hydrotoys.com/rxp/> pp. 4-5.

Ulusses Ronquillo 'Re: pictures of Riva Ultra 250/260 Intake Grate. In Teammoto Kawasaki Team & Race Research [online]. May 20, 2009: 09:31 [retrieved on Sep. 6, 2009]. Retieved from the internet: < URL: http://www.teammotoracing.com/?p=569>.

Riva Yamaha, GPR Race Grate / Pump Shoe, Part #—RY22520, May 11, 2001.

Sea Doo Intake Grates, 2003, [online], [retrieved on Nov. 10, 2009]. Retrieved from the Watercraft Werks online shop using Internet < URL:http://watercraftwerks.chainreactionweb.com/index.php?cPath=621>.

| INLET GRATE CONFIGURATION | SPEED | RPM | PRESSURE AT POSITION (psig) | | |
|---|---|---|---|---|---|
| | | | A | B | C |
| REGULAR INLET GRATE USED ON BRP SPEEDSTER 200 SPORT BOAT | 65.1 | 7800 | 13.4 | 16.1 | 17.5 |
| INLET GRATE WITH FRONT DEFLECTOR IN ACCORDANCE WITH THE INVENTION | 65 | 7800 | 6.4 | 12.8 | 14.3 |

FIG. 20

INLET GRATE FOR A WATER JET PROPULSION SYSTEM

CROSS-REFERENCE

The present application is a continuation of U.S. patent application Ser. No. 12/551,259, filed Aug. 31, 2009, the entirety of which is incorporated herein by reference.

FIELD OF THE INVENTION

The present invention relates to an inlet grate for a water jet propulsion system and to a watercraft having a water jet propulsion system with an inlet grate.

BACKGROUND OF THE INVENTION

Water jet powered watercraft have become very popular in recent years for recreational use and for use as transportation in coastal communities. Water jet propelled watercraft offer high performance, improved acceleration and handling, and shallow-water operation. Accordingly, personal watercrafts (PWCs), which typically employ water jet propulsion units, have become popular, especially in resort areas. As the use of PWCs has increased, a desire for improved performance, including greater operational efficiency, also has increased.

Typically, water jet powered watercraft, such as PWCs, have a water jet propulsion system mounted within the hull that ingests water from a body of water and expels the water at a high velocity from the stern to propel the watercraft. For directional control, a nozzle is generally provided at the outlet of the jet pump and turning is achieved by redirecting the flow of water from the nozzle.

In the typical arrangement for a water jet propulsion unit, an engine output shaft is rotationally coupled to a drive shaft. The drive shaft extends into a water passage, which is defined in part by the hull of the watercraft partially below the water line. The water passage extends from a point forward of the rear of the watercraft to the rear of the watercraft. An impeller disposed within a pump housing portion of the water passage is attached to the drive shaft.

FIG. 12 shows a prior art water jet propulsion system 600 disposed within a hull 612, of which only a portion is shown in broken lines. As shown, an inlet grate 642 is disposed at an inlet 686 to an intake ramp 688. The inlet grate 642 prevents large rocks, weeds, and other debris from entering the water intake ramp 688 and passing through the water jet propulsion system 600. A pump support 650 or ride shoe forms the bottom portion 692 of the water intake ramp 688. The pump support 650 is coupled to the hull 612 within a tunnel 694 through fasteners and/or adhesives (not shown). The pump support 650 includes a main body portion 651 having a vertical attachment surface 652, a forward attachment location 654 that is secured to a ride plate 696, and a ramp portion 656. The ramp portion 656 forms the bottom portion 692 of the water intake ramp 688.

From the water intake ramp 688, water enters into a jet pump 660. The jet pump 660 includes an impeller 670 and a stator 680. The impeller includes blades 672 that extend from a center portion 674 that is coupled to an engine by one or more shafts 698, such as a drive shaft and/or an impeller shaft. The rotation of the impeller 670 pressurizes the water, which then moves over the stator 680 that comprises a plurality of fixed stator blades 682. The role of the stator blades 682 is to decrease the rotational motion of the water so that almost all the energy given to the water is used for thrust, as opposed to swirling the water. As shown, the impeller 670 and the stator

680 are both disposed within a jet propulsion unit housing 690 or pump housing. However, it is also known to position the stator 680 at a position outside of the housing 690 at a position downstream of the housing 690. The housing 690 includes a peripheral wall 691 which defines a passage through which water passes. A forward end 692 of the housing peripheral wall 691 is attached to the vertical attachment surface 654 or the pump support 650. The forward end 692 of the housing peripheral wall 691 defines the inlet into the housing 690.

Once the water leaves the jet pump 660, it goes through a venturi 610. In this prior art water jet propulsion unit 600, the venturi 610 is disposed at the rearward end of the housing 690. Since the venturi's exit diameter is smaller than its entrance diameter, the water is accelerated further, thereby providing more thrust. As shown, the venturi 610 is integrated into the housing 690 and comprises the outlet from the housing 690.

A steering nozzle 602 is pivotally attached to the venturi 610 so as to pivot about a vertical axis 604. The steering nozzle 602 is operatively connected to a steering mechanism such as a steering handlebar (see, e.g., the steering handlebar 74 shown in FIG. 1). Rotation of the steering handlebar causes the steering nozzle 602 to pivot around the vertical axis 604, thereby directing the water discharge to result in a change in the steering direction of the watercraft.

A water passage 695, through which water passes from left to right, is illustrated in FIG. 12. Moving from left to right in this illustration, which is upstream to downstream, the water passage 695 is defined by the inlet 686, the water intake ramp 688, the pump support passage 653, the jet pump 660, the venturi 610 and the steering nozzle 602.

When the amount of water passing through the water jet propulsion system 600 is not optimized, it is possible that cavitation may occur as a result of operation of the impeller 670. Cavitation occurs when an object, such as the impeller 670, moves through a fluid, such as water, to cause turbulence and, at a sufficient speed, creates pockets of vapor. In other words, the impeller 670 can rotate so quickly that, at the tips of the impeller blades 672, a sufficiently low pressure region may be created that the water will flash into vapor, creating small vapor bubbles. When the vapor bubbles collapse, the shock of the collapse can degrade the impeller blades 672 (especially at the tips of the blades 672) by "eating away" at or pitting the blades 672. In addition, cavitation also has the undesired effect of producing noise and vibration that also degrade the operational efficiency of the water jet propulsion system 608. In addition, noise and vibration increases the stress and wear and tear on the impeller 670 and components attached thereto.

In addition, when the watercraft is accelerating from a stand still or a low speed condition, the water drawn through the inlet 686 by the action of the pump 660 experiences a drop of static pressure, which is a condition that promotes cavitation. This undesirable drop of pressure can be minimized by increasing the size of the inlet 686, thus optimizing the system for the acceleration mode. In order to increase the flow of water drawn through the inlet 686, vanes or fins are placed in the vicinity of the inlet 686 and well known to those skilled in the art as a "top loader" (not shown) are also commonly used. U.S. Pat. No. 5,114,368 teaches a water jet propulsion system having such a top loader.

Conversely, as the speed of the craft increases, the static pressure in the inlet builds up which leads to a condition that minimizes the formation of cavitation bubbles in the flow, thus improving the propulsive efficiency of the pump 660. However, as the craft's speed increases, the volume of water forced through the inlet 686 increase and reaches a level where it is greater than the volume of water pulled by the jet pump 660. When the watercraft is traveling at high speed, such increasingly high pressure in the area of the inlet 686 and intake ramp 688 may eventually result in the stern of the watercraft to be pressured up and eventually, the bow of the watercraft to dip in the water, which may, in certain circumstances, cause sudden loss of speed and control of the watercraft. Such phenomenon may occur at various speeds depending on the particular design of each watercraft, the size of the opening of the inlet 686 and operation conditions. A larger inlet opening designed to improve the watercraft's acceleration performances will exacerbate this problem and will result in loss of speed and control at lower traveling speed compared to a watercraft having a smaller inlet.

On the other hand, since a large inlet 686 cuts into the planning area of the hull thus increasing the drag, an inlet 686 optimized for acceleration from low speed will also yield lower propulsive efficiency at high speed. Conversely an inlet 686 optimized for high speed will result in poor acceleration performance due to the occurrence of cavitation.

In view of the foregoing, a need has developed for a watercraft with a water jet propulsion system that provides improved operational efficiency. In order to address this need, water jet propulsions systems with variable inlet sizes have been developed.

U.S. Pat. No. 6,872,105 teaches a water jet propulsion system having a mobile structure disposed within the water passage at a position upstream of the jet pump that modulate the amount of water that is allowed to pass through the water passage. The structure can be a flexible fluid filled bag, an adjustable ride plate, and an additional water passage. According to this patent, each of those structures allows a greater amount of water into the water passage during acceleration than when the watercraft travels at higher constant speed.

U.S. Pat. No. 5,658,176 teaches a water jet propulsion system having water passage with an adjustable inlet which adjusts in size according to the traveling speed of the watercraft. The particular system disclosed comprises fixed and floating vanes pivotally attached along their leading edges to longitudinal structures of the inlet of the water passage so that adjustable inlet openings are created between adjacent floating vanes. According to U.S. Pat. No. 5,658,176, as the speed of the watercraft increases, the inlet openings are closed by the floatable vanes and therefore the volume of water forced through the intake ramp is reduced.

A drawback of the systems taught by these patents is that they comprise numerous movable parts that present risks of breaking and premature wear.

Therefore, there is still a need for a watercraft with a water jet propulsion system that provides improved operational efficiency both during acceleration and at high traveling speed without increasing risks of breaking and premature wear.

SUMMARY OF THE INVENTION

It is an object of the present invention to ameliorate at least some of the inconveniences present in the prior art.

It is another object of the present invention to provide a water jet propulsion system for a watercraft and an inlet grate for such a water jet propulsion system that operates efficiently both during acceleration and at high traveling speed while not increasing risks of breaking and premature wear.

It is another object of the present invention to provide an inlet grate and a watercraft implementing an embodiment of the inlet grate.

In one aspect, an inlet grate for a water jet propulsion system to be used in a watercraft having a water passage is provided. The water passage has an inlet. The inlet has a forward area and a rearward area with respect to the watercraft. The inlet grate has a first end portion and second end portion. The first end portion includes a plate adapted to be connected to the forward area of the inlet. The plate is adapted to be disposed at least in part inside the water passage when the grate is installed on the jet propulsion system. The second end portion is adapted to be connected to the rearward area of the inlet. At least one elongated member extends from the first end portion toward the second end portion. At least one deflector has a forward end and a rearward end. The at least one deflector is in contact with the plate. The at least one deflector extends rearward and upward from the first end portion toward the second end portion. The at least one deflector is inclined relative to the elongated member such that at least a portion of a top surface and the rearward end of the at least one deflector are spaced from the plate in a direction perpendicular to the at least one elongated member. The rearward end of the at least one deflector is disposed inside the water passage when the grate is installed on the jet propulsion system.

In a further aspect, the forward end of the at least one deflector is connected to the first end portion.

In an additional aspect, the first end portion and the at least one deflector are integrally formed.

In a further aspect, the plate is a first plate and the second end portion includes a second plate adapted to be connected to the rearward area of the inlet.

In an additional aspect, the at least one elongated member is at least two elongated members extending from the first end portion toward the second end portion. The at least one deflector extends between at least two of the at least two elongated members.

In a further aspect, portions of sides of the at least one deflector are connected to the at least two elongated members.

In an additional aspect, a first line extending from the first end portion to the second end portion defines an acute angle with a second line extending from the forward end of the at least one deflector to the rearward end of the at least one deflector.

In a further aspect, the acute angle is between 0° and 45°.

In an additional aspect, the at least one elongated member extends from the first end portion to the second end portion.

In a further aspect, a position of the at least one deflector relative to the at least one elongated member is fixed.

In a further aspect, a top loader is connected to the at least one elongated member between the at least one deflector and the second end portion.

In an additional aspect, the forward end of the at least one deflector is in contact with the plate.

In another aspect, a watercraft has a hull, a deck disposed on the hull, and a water jet propulsion system connected to the hull and having a water passage. The water passage has an inlet. The inlet has a forward area and a rearward area. The water passage is defined at least in part by a wall extending upwardly and rearwardly from a forward area of the inlet. An engine is supported by the hull and is adapted to drive the water jet propulsion system. At least one elongated member extends from the forward area of the inlet toward the rearward area of the inlet. A plate is connected to the forward area of the inlet. At least one deflector has a forward end and a rearward end. The at least one deflector is in contact with the plate. The at least one deflector extends rearward and upward from the forward area of the inlet toward the rearward area of the inlet. The at least one deflector is inclined relative to the inlet such that at least a portion of a top surface and the rearward end of the at least one deflector are spaced from the wall in a direction perpendicular to the at least one elongated member. The rearward end of the at least one deflector is disposed inside the water passage. The at least one deflector is adapted to deflect a portion of water entering the water passage away from the wall.

In yet another aspect, a watercraft has a hull, a deck disposed on the hull, and a water jet propulsion system connected to the hull and having a water passage. The water passage has an inlet. The inlet has a forward area and a rearward area. The water passage is defined at least in part by a wall extending upwardly and rearwardly from a forward area of the inlet. An engine is supported by the hull and is adapted to drive the water jet propulsion system. At least one elongated member extends from the forward area of the inlet toward the rearward area of the inlet. At least one deflector has a forward end and a rearward end. The at least one deflector is in contact with the forward area of the inlet. The at least one deflector extends upward and rearward from the forward area of the inlet toward the rearward area of the inlet. The at least one deflector is inclined relative to the inlet such that at least a portion of a top surface and the rearward end of the at least one deflector are spaced from the wall in a direction perpendicular to the at least one elongated member. The rearward end of the at least one deflector is disposed inside the water passage. The at least one deflector is adapted to deflect a portion of water entering the water passage away from the wall.

In a further aspect, the forward end of the at least one deflector is connected to the forward area of the inlet.

In an additional aspect, the at least one elongated member is at least two elongated members extending from the forward area of the inlet toward the rearward area of the inlet. The at least one deflector extends between at least two of the at least two elongated members.

In a further aspect, portions of sides of the at least one deflector are connected to the at least two elongated members.

In an additional aspect, a first line extending from the forward area of the inlet to the rearward area defines an acute angle with a second line extending from the forward end of the at least one deflector to the rearward end of the at least one deflector.

In a further aspect, a position of the at least one deflector relative to the at least one elongated member is fixed.

In an additional aspect, the forward end of the at least one deflector is in contact with the forward area of the inlet For purposes of this application, the terms related to spatial orientation such as forwardly, rearward, left and right, are as they would normally be understood by a driver of a vehicle sitting thereon in a normal driving position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where:

FIG. 20 is a table showing test results discussed in the detailed description of the preferred embodiment.

DETAILED DESCRIPTION OF THE PREFERRED EMBODIMENTS

The general construction of a personal watercraft 10 in accordance with this invention will be described with respect to FIGS. 1-5. The following description relates to one way of manufacturing a personal watercraft. Obviously, those of ordinary skill in the watercraft art will recognize that there are other known ways of manufacturing and designing watercraft and that this invention would encompass these other known ways and designs.

Figure 1:
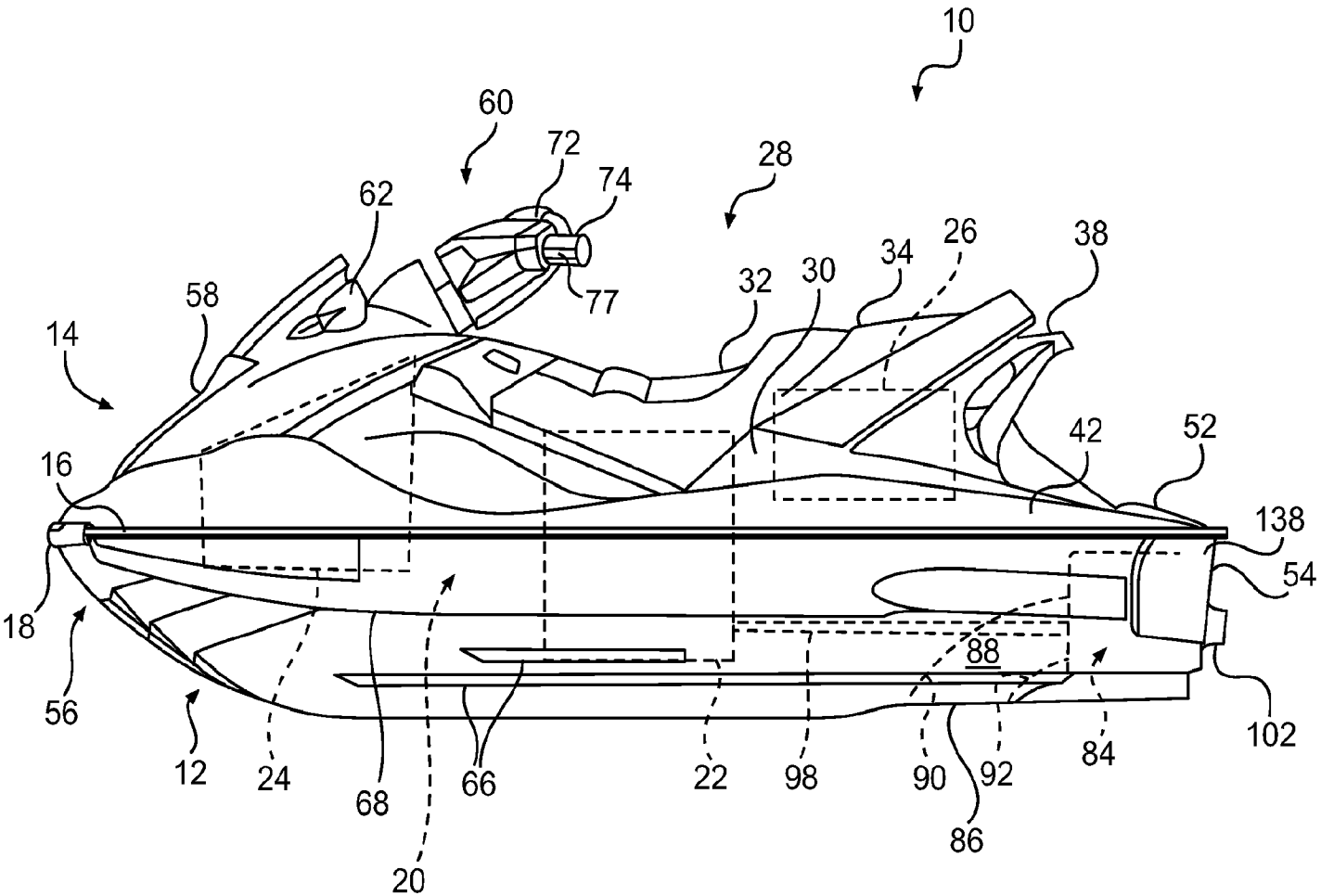
FIG. 1 illustrates a left side elevation view of a personal watercraft in accordance with an embodiment of the invention.

The watercraft 10 of FIG. 1 is made of a hull 12 and a deck 14. The hull 12 buoyantly supports the watercraft 10 in the water. The deck 14 is designed to accommodate one or multiple riders. The hull 12 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow, as shown, or around any portion or all of the seam 16.

The space between the hull 12 and the deck 14 forms a volume commonly referred to as the engine compartment 20 (shown in phantom). The engine compartment 20 accommodates an engine 22, as well as a muffler, tuning pipe, gas tank, electrical system (battery, electronic control unit, etc.), air box, storage bins 24, 26, and other elements required or desirable in the watercraft 10.

Figure 2:
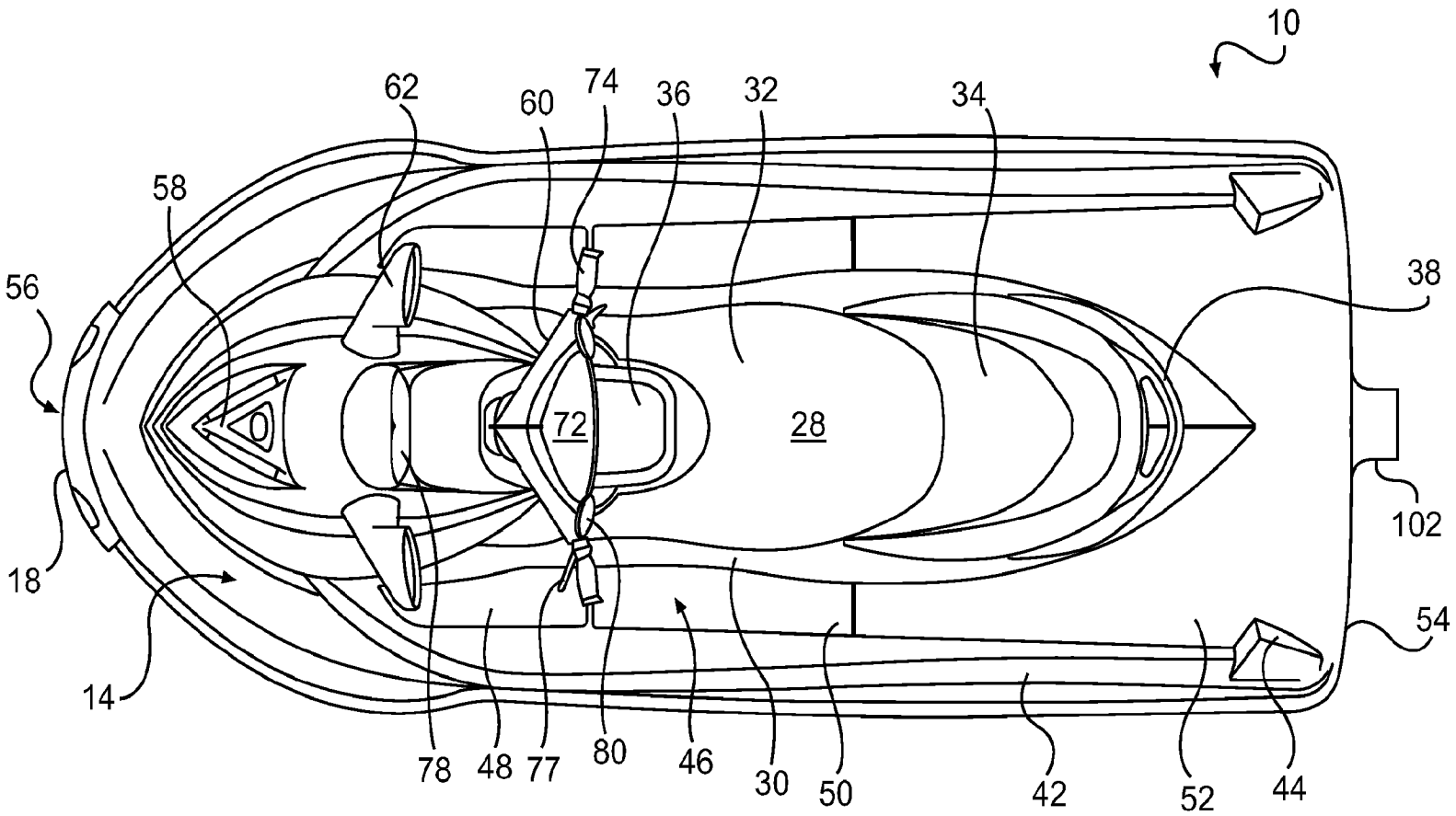
FIG. 2 is a top plan view of the watercraft of FIG. 1.

As seen in FIGS. 1 and 2, the deck 14 has a centrally positioned straddle-type seat 28 positioned on top of a pedestal 30 to accommodate multiple riders in a straddling position. As seen in FIG. 2, the seat 28 includes a first, front seat portion 32 and a rear, raised seat portion 34. The seat 28 is preferably made as a cushioned or padded unit, or as interfitting units. The first and second seat portions 32, 34 are removably attached to the pedestal 30 by a hook and tongue assembly (not shown) at the front of each seat and by a latch assembly (not shown) at the rear of each seat, or by any other known attachment mechanism. The seat portions 32, 34 can be individually tilted or removed completely. Seat portion 32 covers an engine access opening defined by a top portion of the pedestal 30 to provide access to the engine 22 (FIG. 1). Seat portion 34 covers a removable storage box 26 (FIG. 1). A "glove compartment" or small storage box 36 is provided in front of the seat 28.

Figure 4:
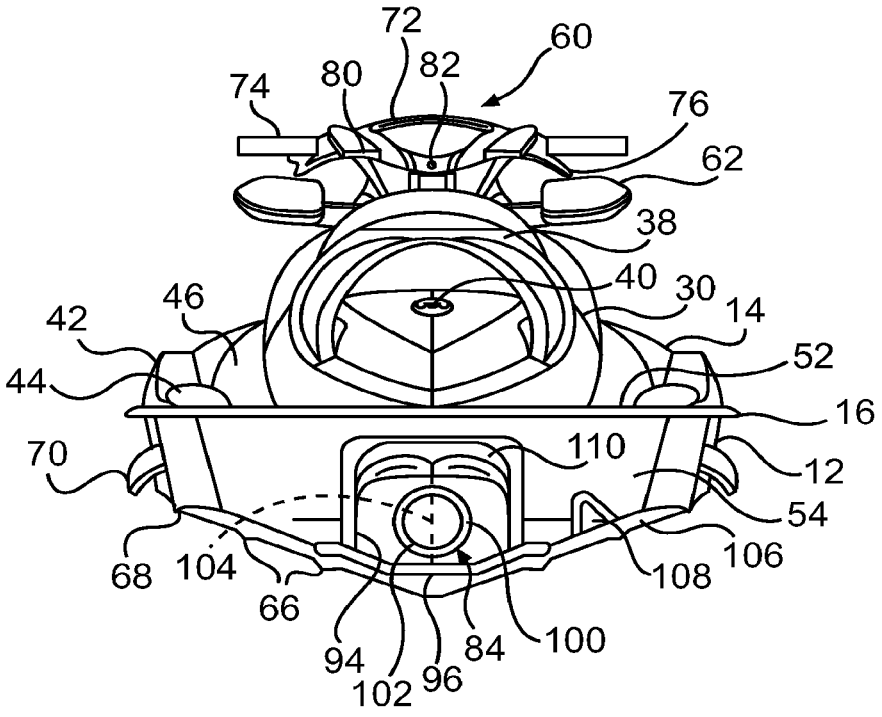
FIG. 4 is a rear elevation view of the watercraft of FIG. 1.

As seen in FIG. 4, a grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4, the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the riders' feet, and also provide buoyancy when turning the watercraft 10, since personal watercraft roll slightly when turning. Towards the rear of the watercraft 10, the gunnels 42 extend inwardly to act as heel rests 44. A passenger riding the watercraft 10 facing towards the rear, to spot a water-skier for example, may place his or her heels on the heel rests 44, thereby providing a more stable riding position. Heel rests 44 could also be formed separately from the gunnels 42.

Located on both sides of the watercraft 10, between the pedestal 30 and the gunnels 42 are the footrests 46. The footrests 46 are designed to accommodate the riders' feet in various riding positions. To this effect, the footrests 46 each have a forward portion 48 angled such that the front portion of the forward portion 48 (toward the bow of the watercraft 10) is higher than the rear portion of the forward portion 48. The remaining portions of the footrests 46 are generally horizontal. Of course, any contour conducive to a comfortable rest for the riders could be used. The footrests 46 are covered by carpeting 50 made of a rubber-type material, for example, to provide additional comfort and traction for the feet of the riders.

A reboarding platform 52 is provided at the rear of the watercraft 10 on the deck 14 to allow the rider or a passenger to easily reboard the watercraft 10 from the water. Carpeting or some other suitable covering may cover the reboarding platform 52. A retractable ladder (not shown) may be affixed to the transom 54 to facilitate boarding the watercraft 10 from the water onto the reboarding platform 52.

Figure 3:
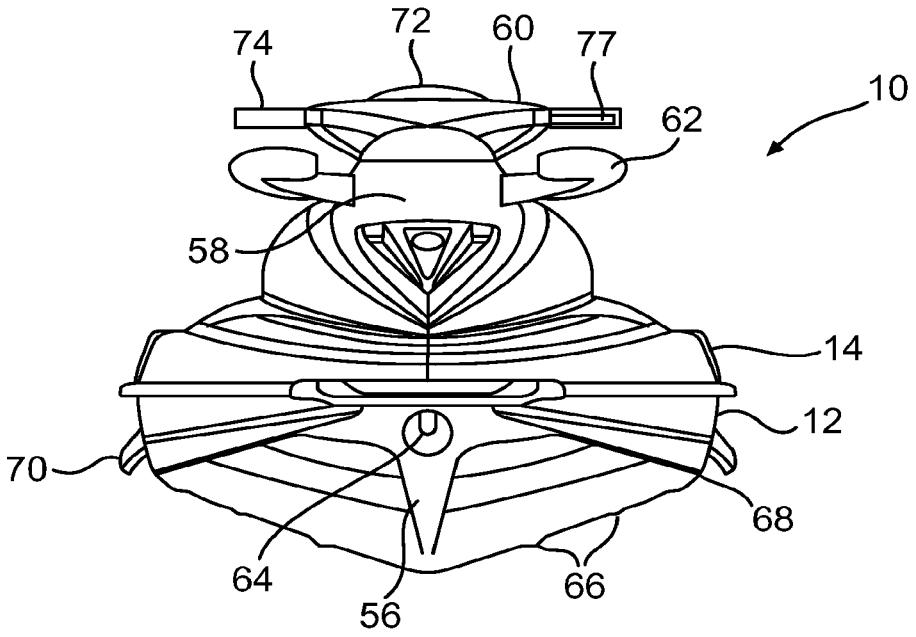
FIG. 3 is a front elevation view of the watercraft of FIG. 1.

Referring to the bow 56 of the watercraft 10, as seen in FIGS. 2 and 3, the watercraft 10 is provided with a hood 58 located forwardly of the seat 28 and a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind the watercraft 10. A hook 64 is located at the bow 56 of the watercraft 10. The hook 64 is used to attach the watercraft 10 to a dock when the watercraft 10 is not in use or to attach to a winch when loading the watercraft 10 on a trailer, for instance.

Figure 5:
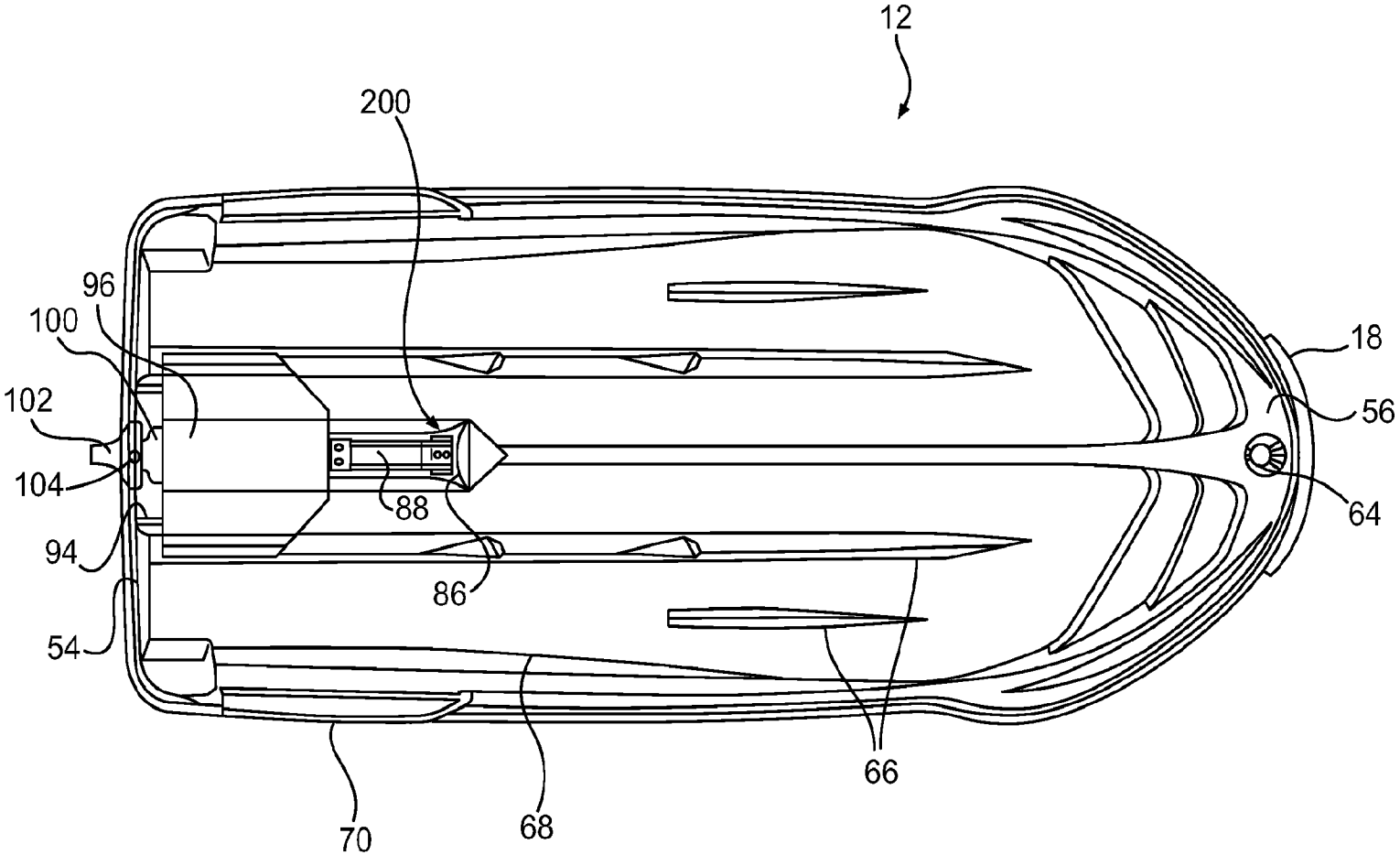
FIG. 5 is a bottom plan view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 have an arcuate undersurface that gives the watercraft 10 both lift while in motion and improved turning characteristics. The sponsons 70 are fixed to the surface of the hull 12 and can be attached to the hull 12 by fasteners or molded therewith. It is contemplated that the position of the sponsons 70 with respect to the hull 12 may be adjustable to change the handling characteristics of the watercraft 10 and accommodate different riding conditions. Trim tabs, which are commonly known, may also be provided at the transom and may be controlled from the helm 60.

As best seen in FIGS. 3 and 4, the helm assembly 60 is positioned forwardly of the seat 28. The helm assembly 60 has a central helm portion 72, that is padded, and a pair of steering handles 74, also referred to as a handlebar. One of the steering handles 74 is provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. In a preferred embodiment, the throttle operator 76 is biased towards the idle position, such that, should the driver of the watercraft 10 let go of the throttle operator 76, it will move to the idle position. The other of the steering handles 74 is provided with a reverse gate operator 77 used by the driver to actuate a reverse gate 110 of the watercraft 10 as described in greater detail below. The reverse gate operator 77 is a finger-actuated lever. However, it is contemplated that the reverse gate operator 77 could be a thumb-actuated lever or a twist grip.

As seen in FIG. 2, a display area or cluster 78 is located forwardly of the helm assembly 60. The display cluster 78 can be of any conventional display type, including a liquid crystal display (LCD), dials or LED (light emitting diodes). The central helm portion 72 has various buttons 80, which could alternatively be in the form of levers or switches, that allow the driver to modify the display data or mode (speed, engine rpm, time . . . ) on the display cluster 78 or to change a condition of the watercraft 10, such as trim (the pitch of the watercraft 10).

The helm assembly 60 is provided with a key receiving post 82 located near a center of the central helm portion 72. The key receiving post 82 is adapted to receive a key (not shown) that starts the watercraft 10. As is known, the key is typically attached to a safety lanyard (not shown). It should be noted that the key receiving post 82 may be placed in any suitable location on the watercraft 10.

Returning to FIGS. 1 and 5, the watercraft 10 is propelled by a water jet propulsion system 84. As is known, the water jet propulsion system 84 pressurizes water to create thrust. The water is first scooped from under the hull 12 through an inlet 86, which has an inlet grate 200. The inlet grate 200 prevents large rocks, weeds, and other debris from entering the water jet propulsion system 84, which may damage the system or negatively affect performance. A detailed description of the inlet grate 200 in accordance with an embodiment of the invention is provided below. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet pump (not shown) of the water jet propulsion system 84 attaches. In such cases, the intake ramp 88 and the jet pump are attached as a unit in a recess in the bottom of hull 12.

From the intake ramp 88, water enters the jet pump. The jet pump is located in a formation in the hull 12, referred to as the tunnel 94. The tunnel 94 is defined at the front, sides, and top by the hull 12 and is open at the transom 54. The bottom of the tunnel 94 is closed by the ride plate 96. The ride plate 96 creates a surface on which the watercraft 10 rides or planes at high speeds.

The jet pump includes an impeller (not shown) and a stator (not shown). The impeller is coupled to the engine 22 by one or more shafts 98, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump, it goes through a venturi 100. Since the venturi's exit diameter is smaller than its entrance diameter, the water is accelerated further, thereby providing more thrust. A steering nozzle 102 is pivotally attached to the venturi 100 so as to pivot about a vertical axis 104. The steering nozzle 102 could also be supported at the exit of the tunnel 94 in other ways without a direct connection to the venturi 100. Moreover, the steering nozzle 102 can be replaced by a rudder or other diverting mechanism disposed at the exit of the tunnel 94 to selectively direct the thrust generated by the water jet propulsion system 84 to effect turning.

Figure 8:
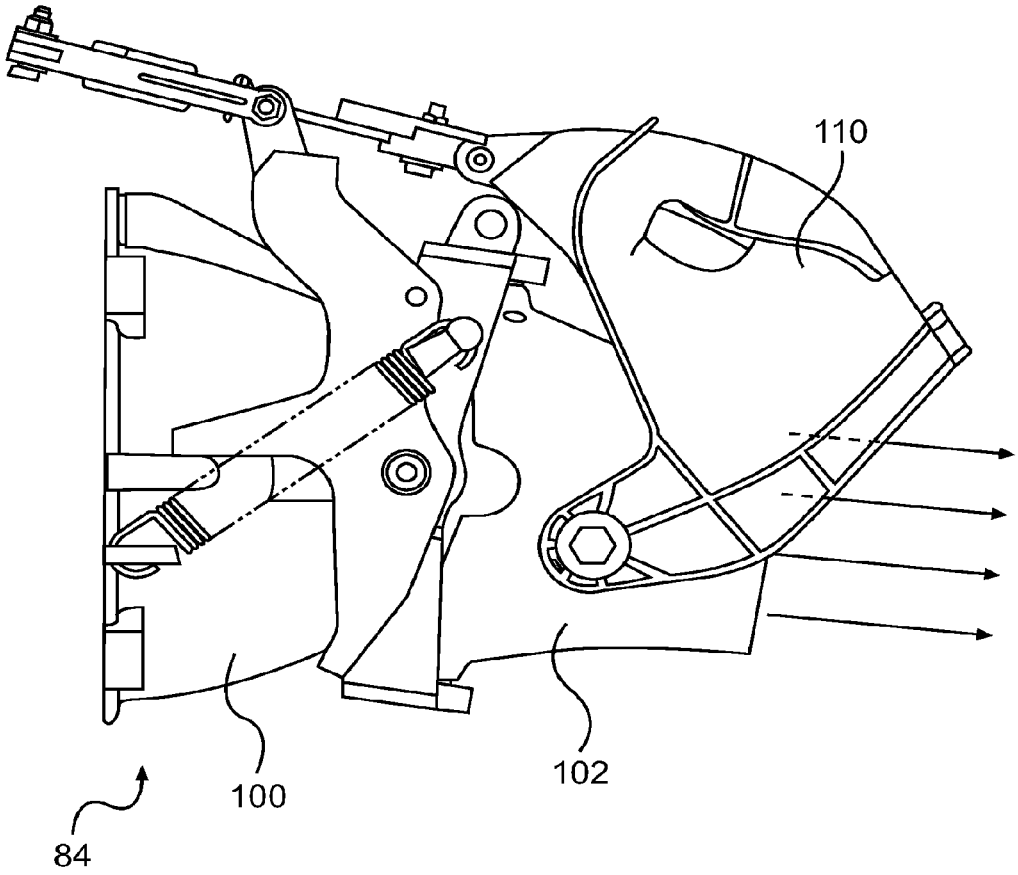
FIG. 8 is a side view of a water jet propulsion system nozzle and reverse gate assembly where the reverse gate is mounted on the nozzle assembly with the reverse gate in a stowed position.
Figure 9:
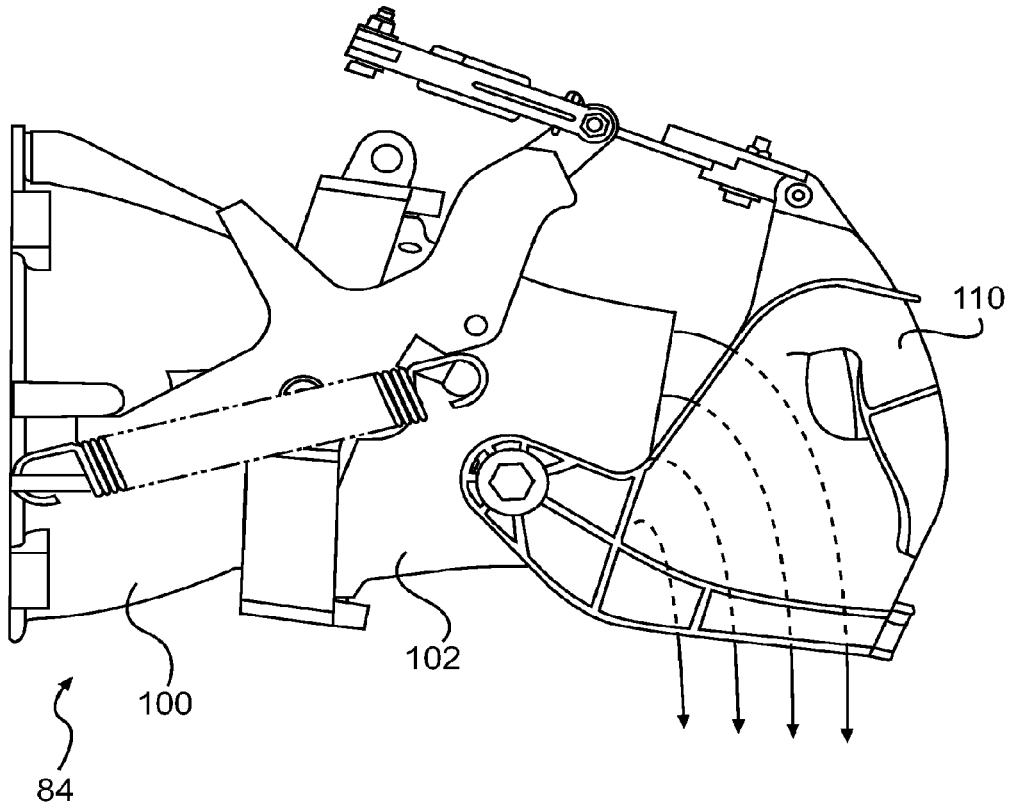
FIG. 9 is a side view of the water jet propulsion system nozzle and reverse gate assembly of FIG. 8 with the reverse gate in a neutral position.

The steering nozzle 102 is operatively connected to the helm assembly 60 preferably via a push-pull cable (not shown) such that when the helm assembly 60 is turned, the steering nozzle 102 pivots. This movement redirects the pressurized water coming from the venturi 100, so as to redirect the thrust and steer the watercraft 10 in the desired direction. Optionally, the steering nozzle 102 may be gimbaled to allow it to move around a second horizontal pivot axis (as shown in FIGS. 8 and 9). The up and down movement of the steering nozzle 102 provided by this additional pivot axis is known as trim and controls the pitch of the watercraft 10.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 also turns faster. An electronic control unit (ECU) (not shown) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art. Alternatively, a global positioning system (GPS) unit could be used to determine the speed of the watercraft 10 by calculating the change in position of the watercraft 10 over a period of time based on information obtained from the GPS unit.

Figure 10:
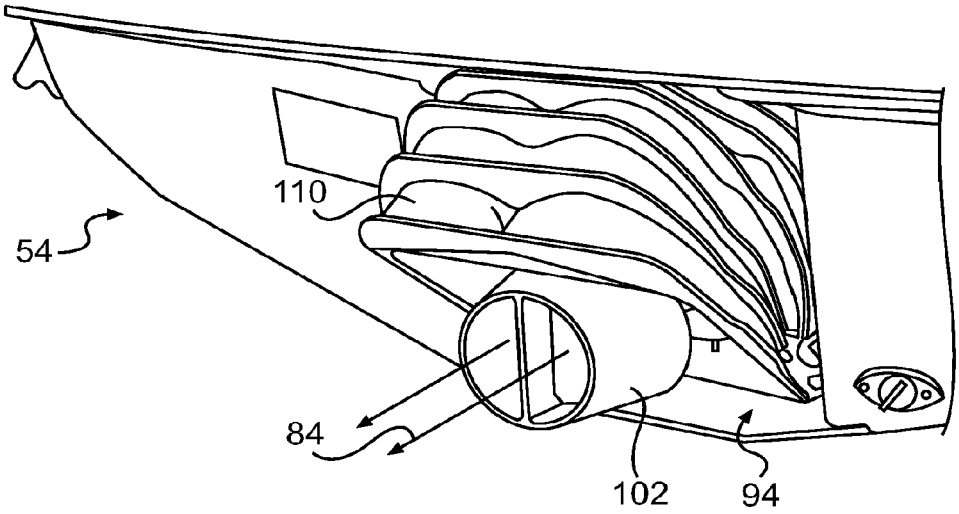
FIG. 10 is a perspective view, taken from a rear, right side, of a transom of a watercraft illustrating a reverse gate mounted to the hull and in a stowed position.
Figure 11:
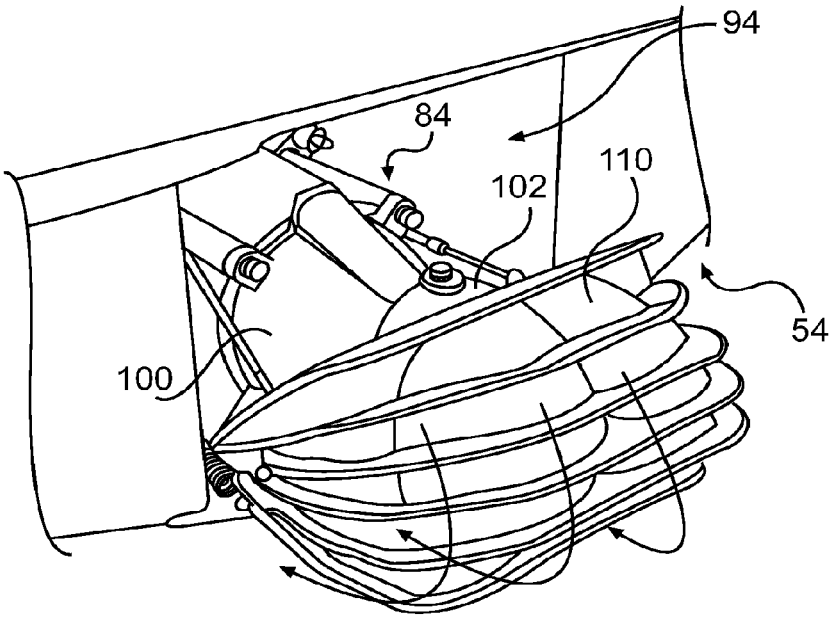
FIG. 11 is a perspective view, taken from a rear, left side, of the transom of FIG. 10 with the reverse gate in a reverse position.
Figure 12:
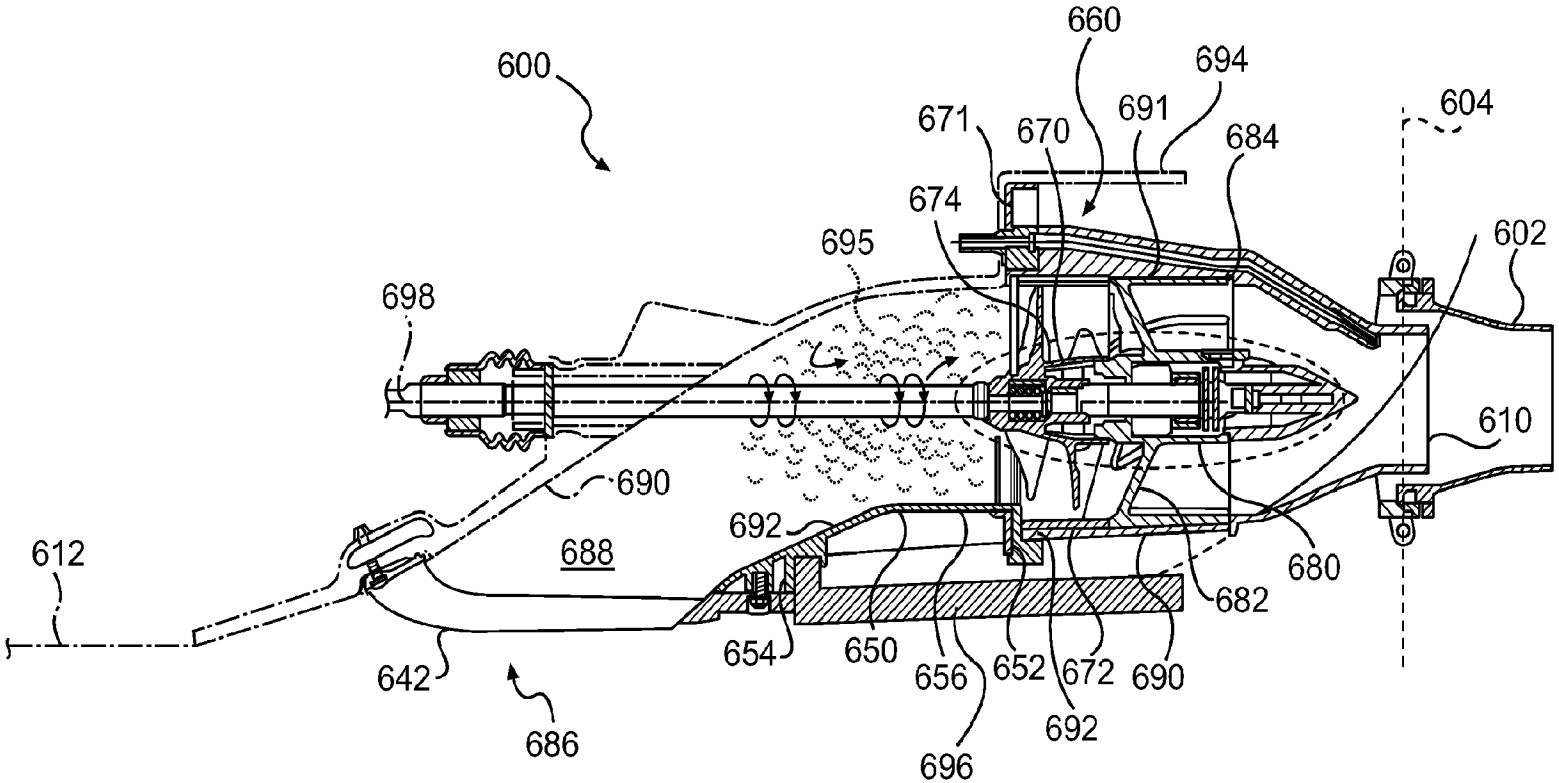
FIG. 12 PRIOR ART
FIG. 12 is a partial, cross-sectional side view of the stern of a watercraft showing a prior art water jet propulsion system.

The watercraft 10 is provided with a reverse gate 110 which is movable between a first stowed position where it does not interfere with the jet of water (indicated by arrows 85) being expelled by the water jet propulsion system 84 and a plurality of positions where it redirects the jet of water 85 being expelled by the water jet propulsion system 84. A reverse gate actuator (not shown) is operatively connected to the reverse gate 110 to move the reverse gate 110. The reverse gate actuator could be any one of a mechanical, a hydraulic, or an electric actuator, such as an electric motor. One contemplated reverse gate actuator is shown and described in U.S. Pat. No. 7,841,915, issued Nov. 30, 2010, the entirety of which is incorporated herein by reference. As seen in FIGS. 8 and 9, it is contemplated that the reverse gate 110 could be mounted directly on the water jet propulsion system 84 so as to move with the steering nozzle 102 as it turns and trims. Details of this arrangement can be found in U.S. Pat. No. 6,533,623 B2, issued Mar. 18, 2003, the entirety of which is incorporated herein by reference. In FIG. 8, the reverse gate 110 is in a stowed position. In FIG. 9, the reverse gate 110 is in a neutral position where it redirects the jet of water 85 downwardly. Since the thrust generated by the redirected jet of water 85 when the reverse gate 110 is in the neutral position does not have a horizontal component, the watercraft 10 will not be accelerated or decelerated by the thrust and will stay in position if it was not moving prior to moving the reverse gate 110 in the neutral position. As seen in FIGS. 10 and 11, it is also contemplated that the reverse gate 110 could be pivotally attached to the sidewalls of the tunnel 94. In FIG. 10, the reverse gate 110 is in a stowed position. In FIG. 11, the reverse gate 110 is in a reverse position as it redirects the jet of water 85 towards the front of the watercraft 10, thus causing the watercraft 10 to move in a reverse direction. Other ways of operatively mounting the reverse gate 110 to the hull 12 are also contemplated.

Figure 6:
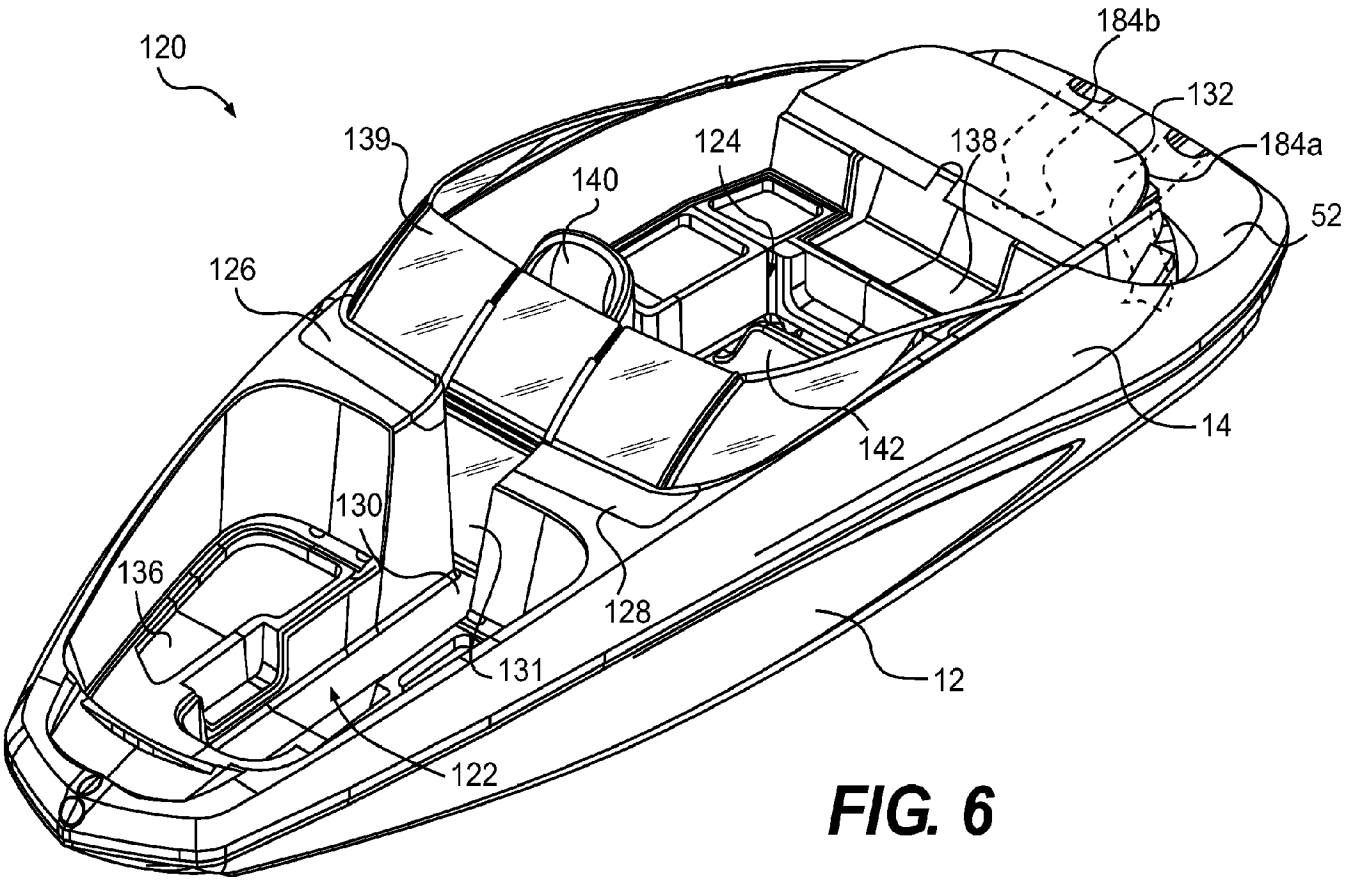
FIG. 6 is a perspective view, taken from a front, left side, of a sport boat in accordance with an embodiment the invention.
Figure 7:
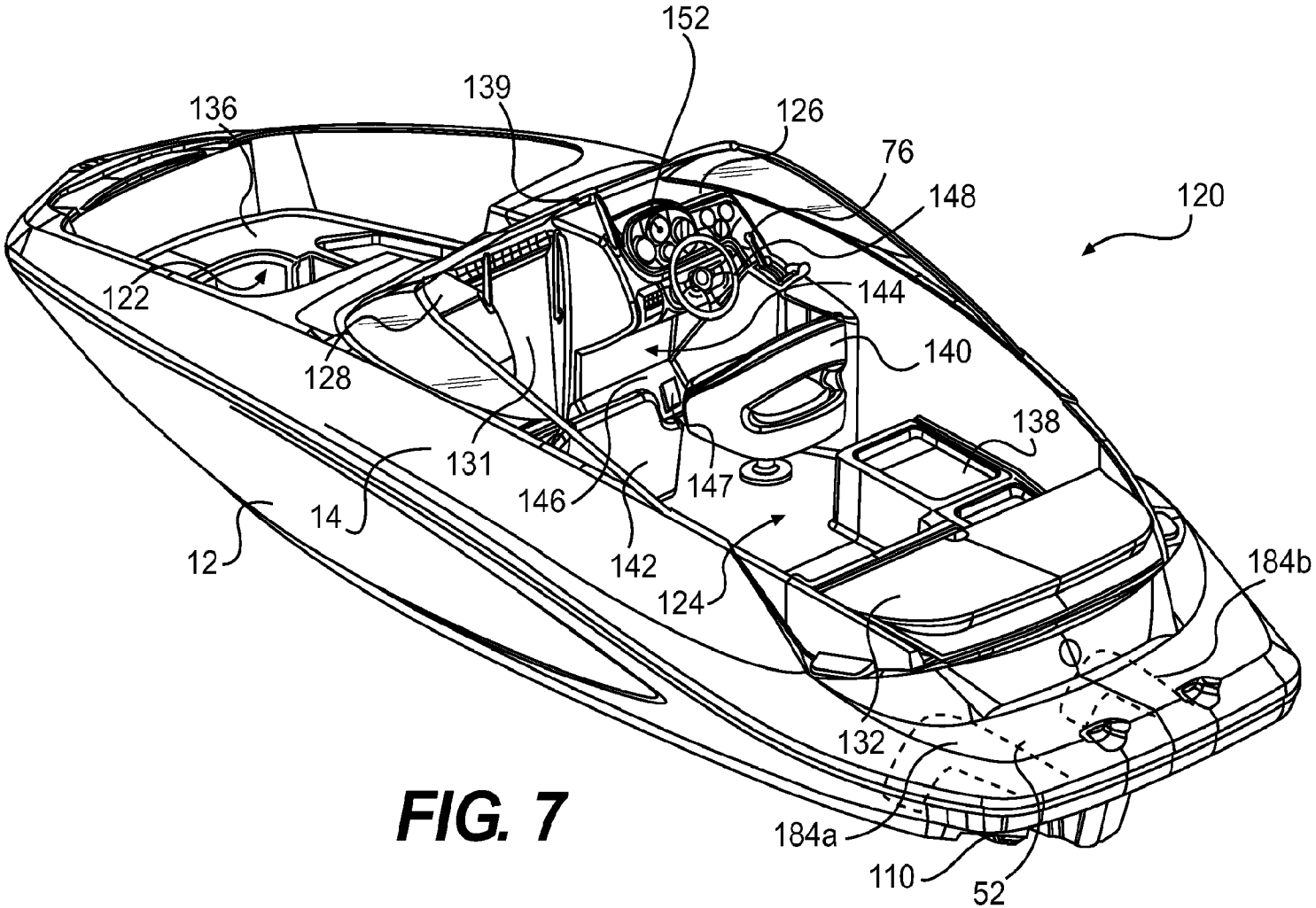
FIG. 7 is a perspective view, taken from a rear, left side, of the sport boat of FIG. 6.

The general construction of a sport boat 120 in accordance with this invention will now be described with respect to FIGS. 6 and 7. The following description relates to one way of manufacturing a sport boat. Obviously, those of ordinary skill in the sport boat art will recognize that there are other known ways of manufacturing and designing sport boats and that this invention would encompass these other known ways and designs.

For simplicity, the components of the sport boat 120 which are similar in nature to the components of the personal watercraft 10 described above will be given the same reference numeral. It should be understood that their specific construction may vary however.

The sport boat 120 has a hull 12 and a deck 14 supported by the hull 12. The deck 14 has a forward passenger area 122 and a rearward passenger area 124. A right console 126 and a left console 128 are disposed on either side of the deck 14 between the two passenger areas 122, 124. A passageway 130 disposed between the two consoles 126, 128 allows for communication between the two passenger areas 122, 124. A door 131 is used to selectively open and close the passageway 130. At least one engine (not shown) is located between the hull 12 and the deck 14 at the back of the boat 120. The engine powers the water jet propulsion system (not shown) of the boat 120. The water jet propulsion system is of similar construction as the water jet propulsion system 84 of the personal watercraft 10 described above, and will therefore not be described again. A reverse gate 110 is operatively mounted to the hull 12. The reverse gate 110 is of similar construction as the reverse gate 110 of the personal watercraft 10 described above, and will therefore not be described again. In a preferred embodiment, the boat 120 has two engines and two water jet propulsion systems each provided with a reverse gate 110. The engine is accessible through an engine cover 132 located behind the rearward passenger area 124. The engine cover 132 can also be used as a sundeck for a passenger of the boat 120 to sunbathe on while the boat 120 is not in operation. A reboarding platform 52 is located at the back of the deck 14 for passengers to easily reboard the boat 120 from the water.

The forward passenger area 122 has a C-shaped seating area 136 for passengers to sit on. The rearward passenger area 124 also has a C-shaped seating area 138 at the back thereof. A driver seat 140 facing the right console 126 and a passenger seat 142 facing the left console 124 are also disposed in the rearward passenger area 124. It is contemplated that the driver and passenger seats 140, 142 can swivel so that the passengers occupying these seats can socialize with passengers occupying the C-shaped seating area 138. A windshield 139 is provided at least partially on the left and right consoles 124, 126 and forwardly of the rearward passenger area 124 to shield the passengers sitting in that area from the wind when the boat 120 is in movement. The right and left consoles 126, 128 extend inwardly from their respective side of the boat 120. At least a portion of each of the right and the left consoles 126, 128 is integrally formed with the deck 14. The right console 126 has a recess 144 formed on the lower portion of the back thereof to accommodate the feet of the driver sitting in the driver seat 140 and an angled portion of the right console 126 acts as a footrest 146. A reverse gate operator, in the form of a foot pedal 147, is provided on the footrest 146. It is contemplated that the foot pedal 147 could be replaced by a handle positioned near or on the steering wheel 200. The function of the foot pedal 147 is similar to that of the reverse gate operator 77 of the personal watercraft 10. As shown in FIGS. 13A to 13C, the foot pedal 147 is operatively connected to the reverse gate 110. When the foot pedal 147 is not actuated, the reverse gate 110 is in the stowed position. Details of this arrangement can be found in United States Patent Publication No. US2010/022145 A1, published Jan. 28, 2010, the entirety of which is incorporated herein by reference. The left console 128 has a recess (not shown) similar to recess 144 to accommodate the feet of the passenger sitting in the passenger seat 142. The right console 126 accommodates all of the elements necessary to the driver to operate the boat. These include, but are not limited to, a helm assembly in the form of the steering wheel 200, a throttle operator 76 in the form of a throttle lever, and an instrument panel 152. The instrument panel 152 have various dials indicating the watercraft speed, engine speed, fuel and oil level, and engine temperature. The speed of the boat 120 is measured by a speed sensor (not shown) which can be in the form of the speed sensor 106 described above with respect to the personal watercraft 10 or a GPS unit or any other type of speed sensor which could be used for marine applications. It is contemplated that the elements attached to the right console 126 could be different than those mentioned above. The left console 128 incorporates a storage compartment (not shown) which is accessible to the passenger sitting the passenger seat 142.

Figure 13:
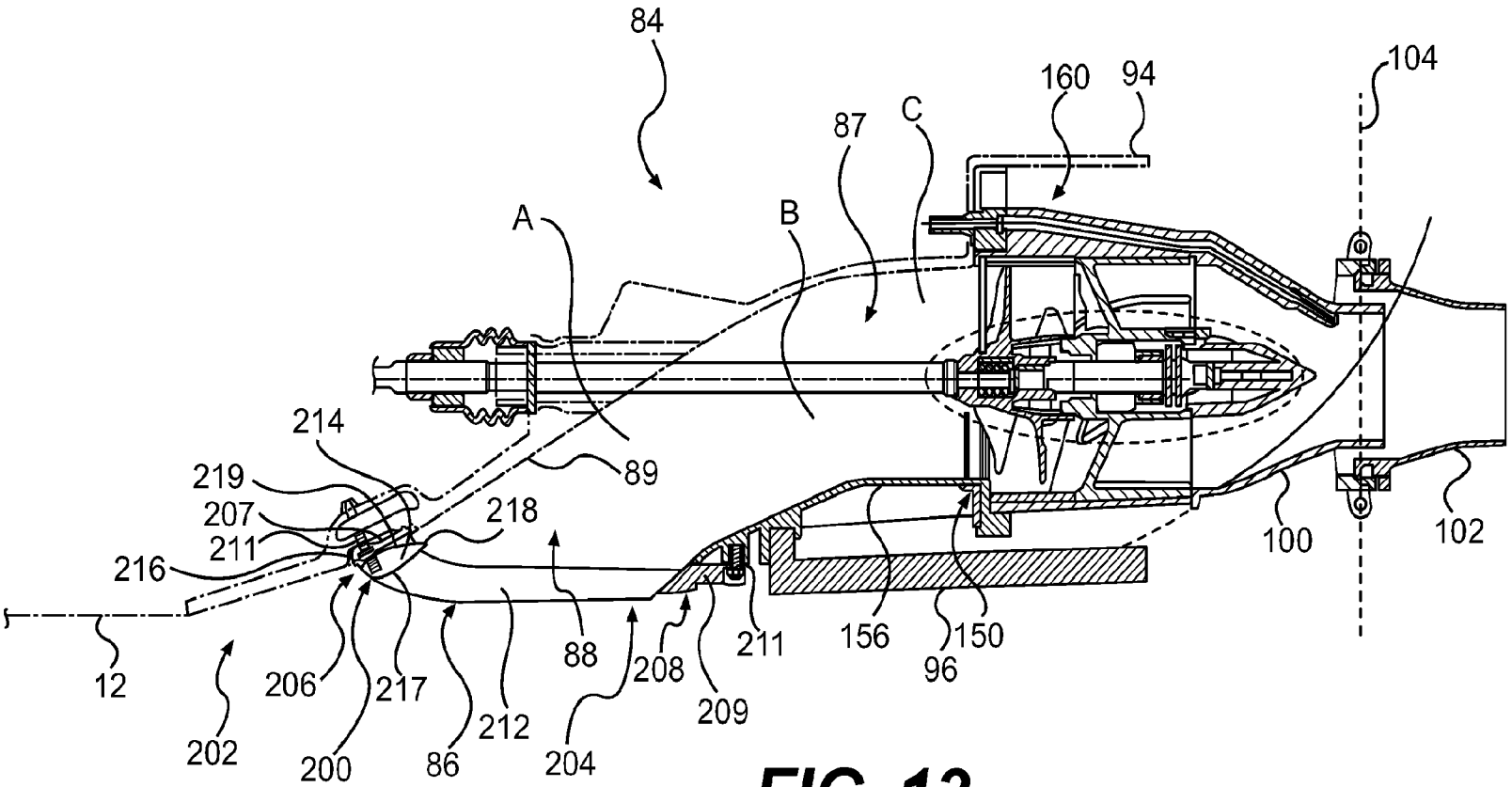
FIG. 13 is a partial, cross-sectional side view of the stern of a watercraft showing an embodiment of a water jet propulsion system comprising an inlet grate in accordance with the present invention.
Figure 14:
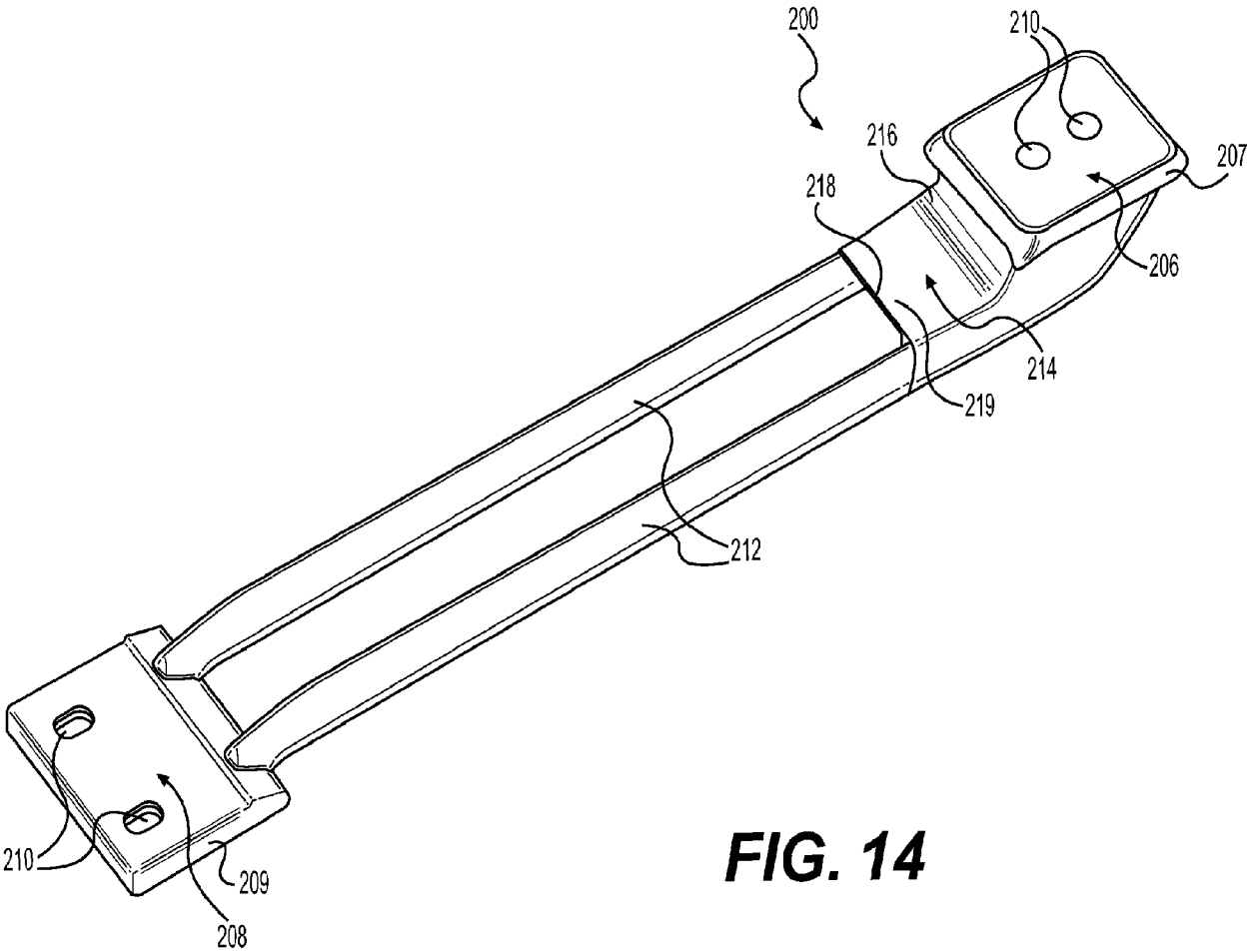
FIG. 14 is a top perspective view of an inlet gate in accordance with another embodiment of the invention.
Figure 15:
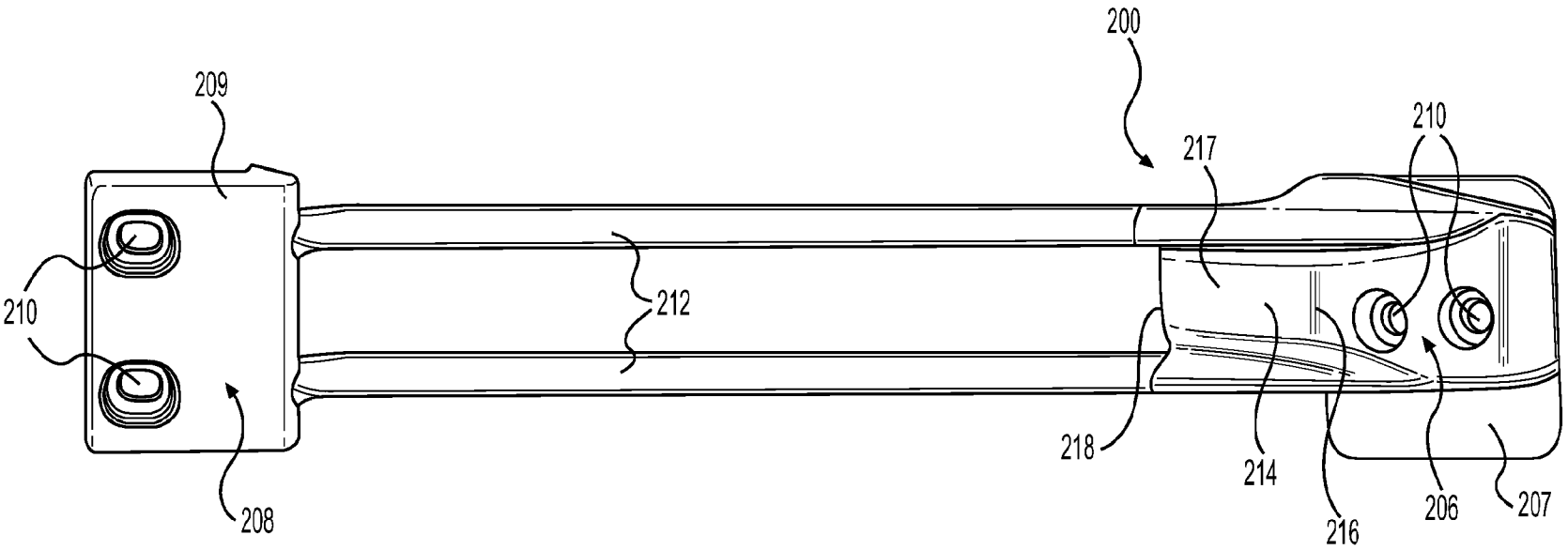
FIG. 15 is a bottom view of an inlet gate in accordance with yet another embodiment of the invention.

Turning to FIG. 13, the water jet propulsion system 84 will now be described in more detail. In this embodiment of the invention, the water jet propulsion system 84 is mounted to a watercraft such as a PWC or a sport boat having only one water jet propulsion system. The water jet propulsion system 84 comprises an inlet grate 200 in accordance with the present invention. The water jet propulsion system 84 is disposed within the hull 12, of which only a portion is shown in broken lines to reveal the details of the water jet propulsion system 84.

As is shown in FIG. 13, the water jet propulsion system 84 includes an inlet 86 in the hull 12 that leads to a water intake ramp 88 in the tunnel 94. A pump support 150 is secured within the tunnel 94. The water intake ramp 88 is defined by an interior wall 89 and a ramp portion 156 of the pump support 150. The jet pump 160 is secured within the tunnel 94 to the pump support 150. The venturi 100 and the steering nozzle 102 that pivot about the vertical axis 104 are disposed at the rearward end of the tunnel 94. The inlet 86, intake ramp 88, tunnel 94, venturi 100 and steering nozzle 102 define a water passage 87 through which water used in the water jet propulsion system 84 is flowing.

Figure 16:
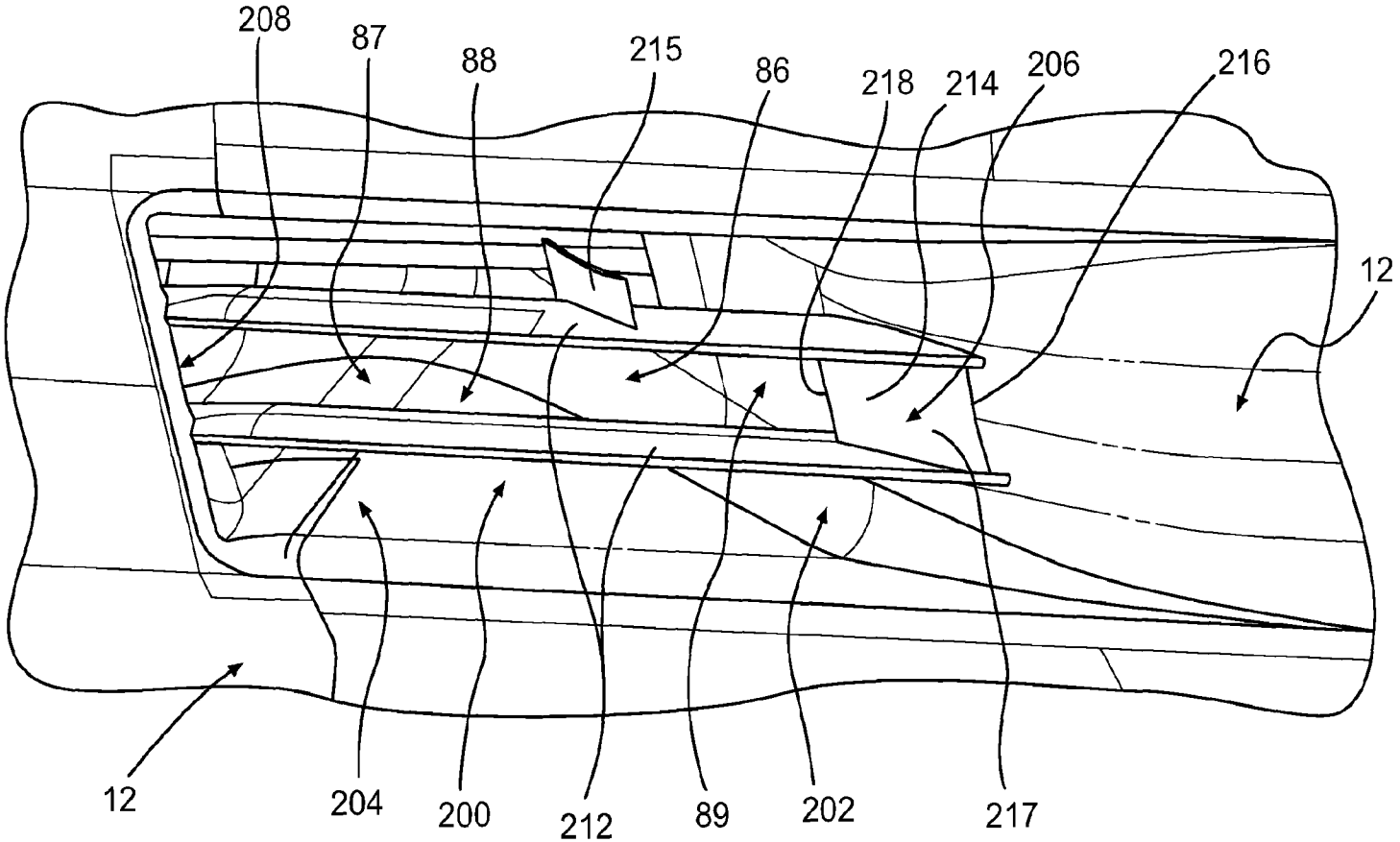
FIG. 16 is a bottom perspective view of a portion of the hull of a personal watercraft having a water inlet and an inlet grate in accordance with another embodiment of the invention.
Figure 18:
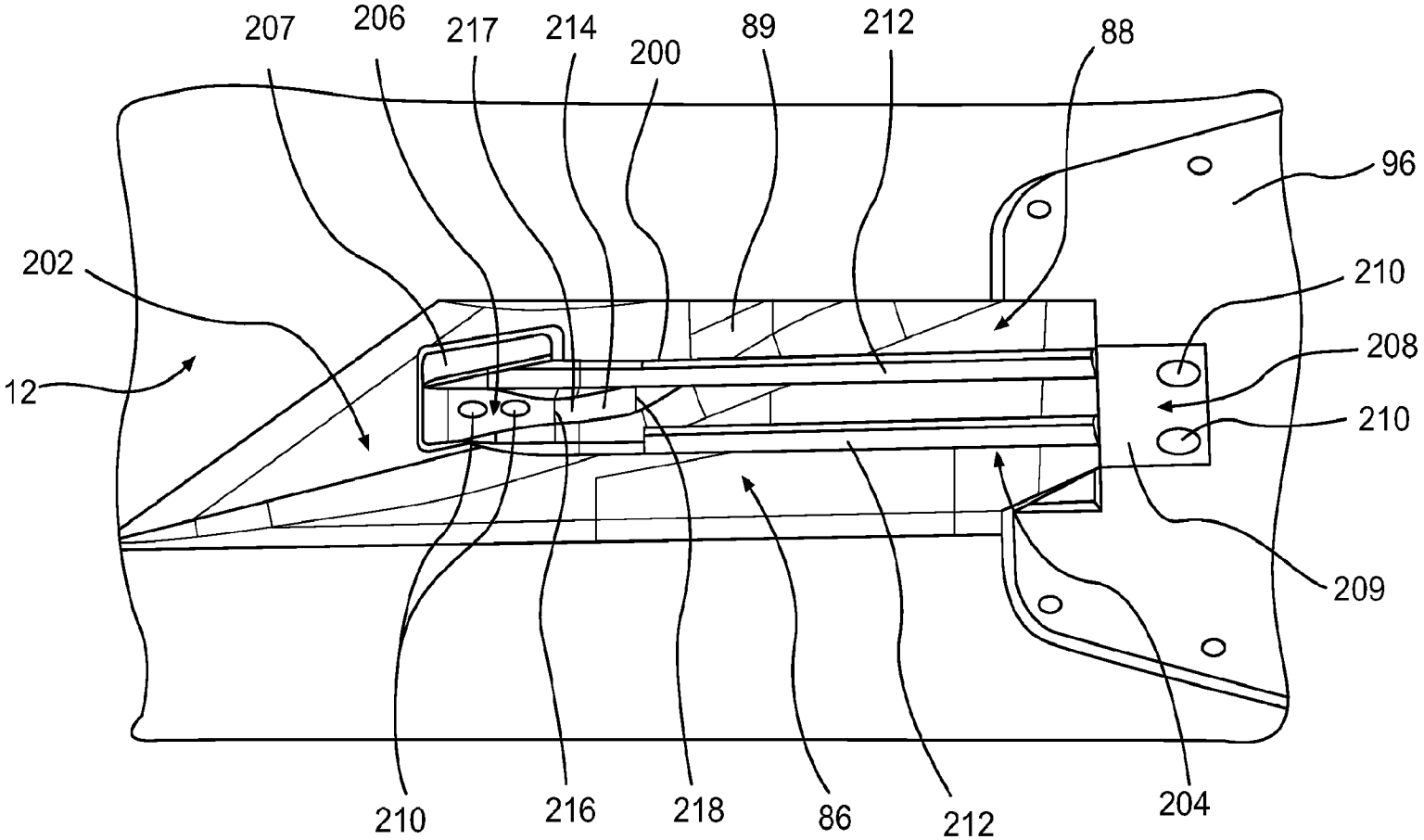
FIG. 18 is a bottom perspective view of a portion of the hull of a sport boat having two water jet propulsion systems, each one having a water inlet and an inlet grate in accordance with another embodiment of the invention.

As shown in FIGS. 13, 16 and 18, the inlet 86 has a forward area 202 and a rearward area 204.

As shown in FIGS. 13 to 19, the inlet grate 200 has a first end portion 206 and a second end portion 208. The first end portion 206 of the inlet grate 200 is adjacent to the forward area 202 of the inlet 86 and connected thereto through a first plate 207. The first end portion 206 of the inlet grate 200 includes the first plate 207. The second end portion 208 of the inlet grate 200 is adjacent to the rearward area 204 of the inlet 86 and connected thereto through a second plate 209. The second end portion 208 of the inlet grate 200 includes the second plate 209. In the particular embodiments of the invention shown in FIGS. 13 to 19, the inlet grate 200 is connected to the inlet 86 by bolts 211 passing through apertures 210 defined in the first and second plates 207, 209 of the inlet grate 200. In an alternative embodiment of the invention, a seal (not shown) may be disposed between the first and second plates 207, 209 of the inlet grate 200 and the forward and rearward areas 202, 204 of the inlet 86.

Elongated members 212 extend from the first end portion 206 of the inlet grate 200 to the second end portion 208 of the inlet grate 200. In an alternative embodiment of the invention, the elongated members 212 extend from the first end portion 206 of the inlet grate 200 toward but without reaching the second end portion 208 of the inlet grate 200, leaving a gap between the ends on the elongated members 212 and the rearward area 204 of the inlet 86.

A deflector 214 extends from the first end portion 206 of the inlet grate 200 toward the second end portion 208 of the inlet grate 200. As shown in FIGS. 14 to 19, the deflector 214 has a forward end 216, a rearward end 218, a bottom surface 217 and a top surface 219.

Figure 17:
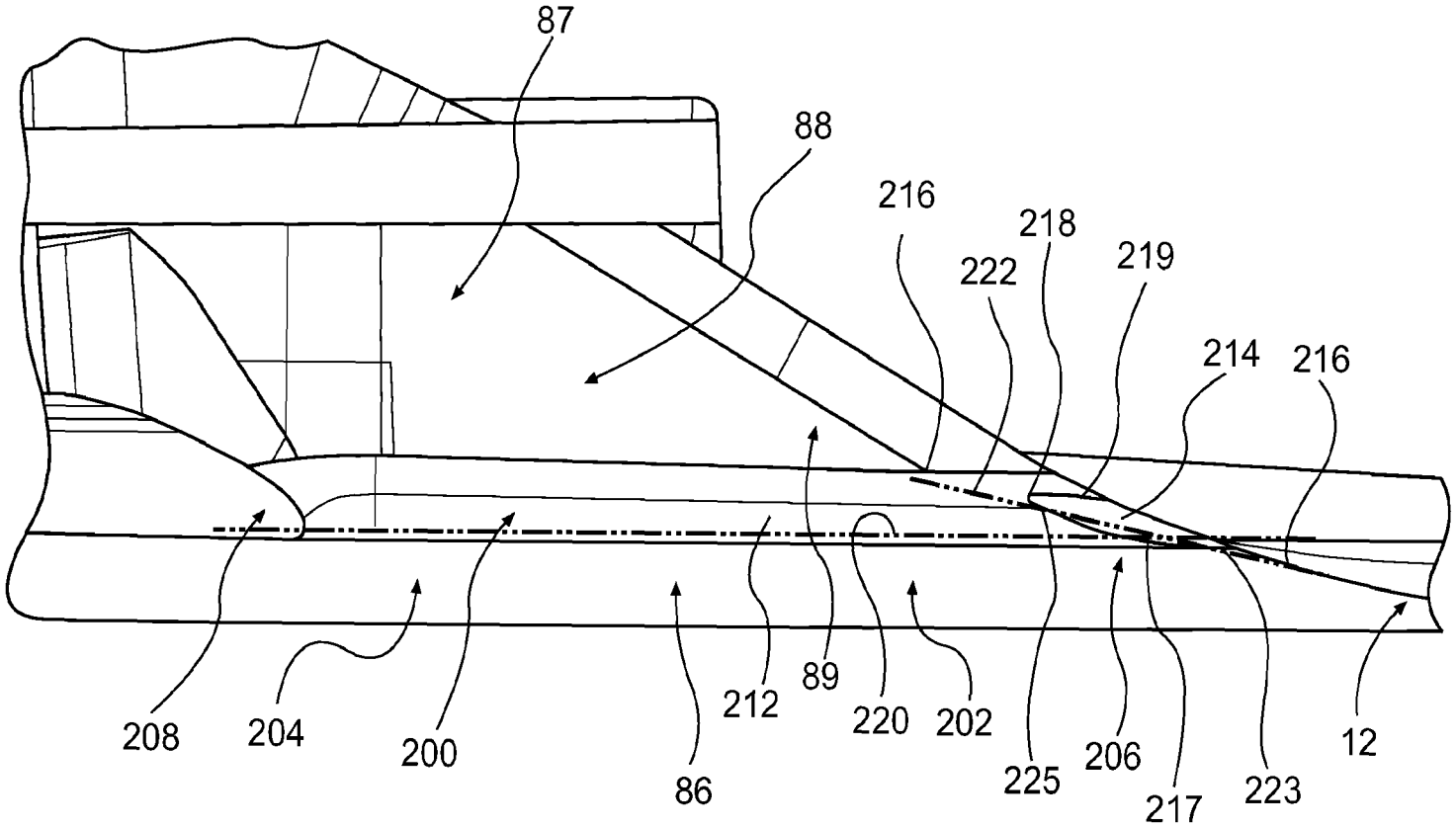
FIG. 17 is a partial, cross-sectional side view of the stern of a watercraft showing an embodiment of a water jet propulsion system comprising an inlet grate in accordance with yet another embodiment of the present invention.

As shown in FIG. 17, a first line 220 extending from the first end portion 206 of the inlet grate 200 to the second end portion 208 of the inlet grate 200 defines an angle of approximately 10° with a second line 222 extending from a point 223 on the bottom surface 217 at the forward end 216 of the deflector 214 to a point 225 on the bottom surface 217 at the rearward end 218 of the deflector 214. As shown in FIG. 17, the inclination of the bottom surface 217 of the deflector 214 is substantially similar to the inclination of the portion of the exterior wall of the hull 12 in the vicinity of the forward area 202 of the inlet 86.

Figure 19:
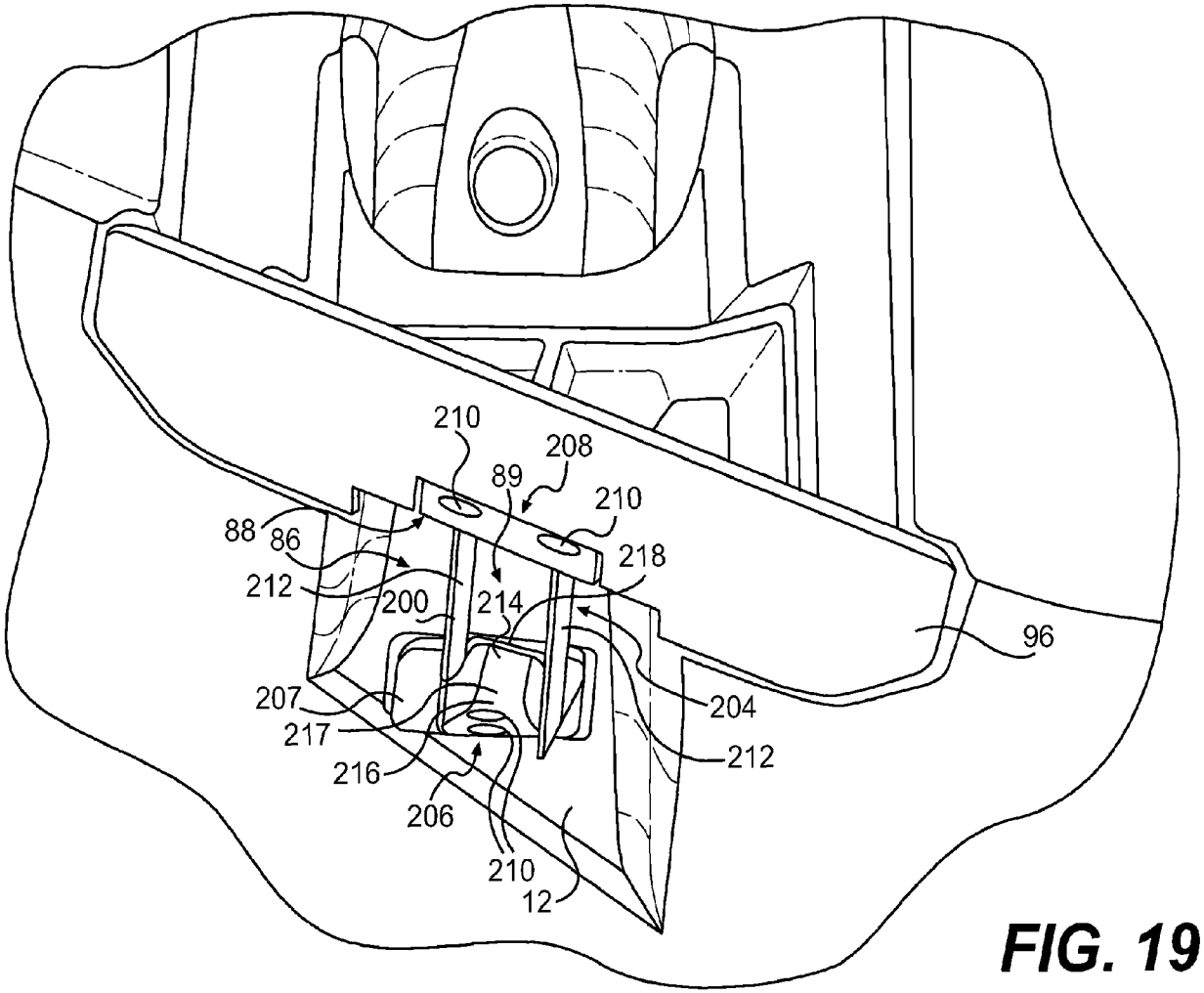
FIG. 19 is a bottom perspective view of a portion of the hull of a sport boat having two water jet propulsion systems, each one having a water inlet and an inlet grate in accordance with the embodiment of the invention shown in FIG. 18.

In alternative embodiments of the invention (not shown), the first line 220 and second line 222 may define acute angles between 0° to 45°. In a prefer embodiment of the invention (not shown), the first line 220 and second line 222 may define acute angles between 9° to 26°. As shown in FIGS. 13, 17 and 19, when the inlet grate 200 is installed on a watercraft, the rearward end 218 of the deflector 214 is disposed inside the water passage 87 of the water jet propulsion system 84 in the vicinity of the water intake ramp 88. In yet another alternative embodiment of the invention (not shown), the inclination of the bottom surface 217 of the deflector 214 is substantially similar to the inclination of the exterior wall of the portion of the hull 12 in the vicinity of the forward area 202 of the inlet 86.

In the embodiments of the invention shown in FIGS. 13 to 19, the deflector 214 is essentially a plate having a slightly curved bottom surface 217 extending from the first end portion 206 of the inlet grate 200 between the elongated members 212. In alternative embodiments of the invention, the deflector 214 can take various shapes and the bottom surface 217 can be generally planar or curved. In yet other alternative embodiments of the invention, the bottom surface 217 and top surface 219 of the deflector 214 presents several curves.

The forward end 216 of the deflector 214 is adjacent and connected to the first end portion 206 of the inlet grate 200. It is contemplated that the deflector 214 could be connected to other portions of the inlet grate 200 such as the elongated members 212. In the embodiment of the invention shown in FIGS. 13 to 19, the deflector 214 is integrally formed with the first end portion 206 of the inlet grate 200. In alternative embodiments of the invention (not shown) the deflector 214 and first end portion 206 of the inlet grate 200 are manufactured as two distinct parts.

In the embodiments of the invention shown in FIGS. 13 to 19, the deflector 214 is adjacent and connected to two elongated members 212. In an alternative embodiment of the invention (not shown) the deflector 214 is disposed so as to be adjacent and connected to only one elongated member 212. In yet another alternative embodiment of the invention (not shown), at least two deflectors 214 extend from the first end portion 206 of the inlet grate 200 either between a same space defined between two elongated members 212 or between different spaces defined by a plurality of elongated members 212, each deflector 214 being disposed so as to be adjacent and connected to two or only one elongated members 212. In yet another alternative embodiment of the invention (not shown), a single deflector 214 is disposed so as to be adjacent and connected to a plurality of elongated members 212.

In the embodiments of the invention shown in FIGS. 13 to 19, the first and second end portions 206, 208 of the inlet grate 200, the first and second plates 207, 209, the elongated members 212 and the deflector 214 are integrally formed. In alternative embodiments of the invention (not shown) the first and second end portions 206, 208 of the inlet grate 200, the first and second plates 207, 209, the elongated members 212 and the deflector 214 are manufactured as distinct parts connected together through various means that would be apparent for one skilled in the art, including welding or use of suitable fasteners such as bolt and nuts assembly or rivets.

In the embodiments of the invention shown in FIGS. 13 to 19, the first and second end portions 206, 208 of the inlet grate 200, the first and second plates 207, 209, the elongated members 212 and the deflector 214 are made of casted aluminum. It is contemplated that, in alternative embodiments of the invention, the first and second end portions 206, 208 of the inlet grate 200, the first and second plates 207, 209, the elongated members 212 and the deflector 214 could be made of the same or various materials suitable for such use, including various plastics or composite material as well as various non-corrosive metallic materials such as aluminum or stainless steel. In alternative embodiments of the invention, the inlet grate 200 can be made of a single piece of moulded plastic or of a number of extruded parts of aluminium welded together.

When the watercraft is in operation, traveling forward, a portion of the water flowing from the front of the watercraft below the hull 12 will follow a first flow path defined by the forward area 202 of the inlet 86, the first end portions 206 of the inlet grate 200 and the deflector 214. This first flow path directs the portion of water entering the water passage 87 through the inlet 86 in the area where the deflector 214 extends, away from the interior wall 89 of the water intake ramp 88.

Due to the presence and orientation of the deflector 214, as the speed of the watercraft increases, an increasing portion of the volume of water that would otherwise be forced directly through the inlet 86 is forced to follow the flow path directed away from the interior wall 89 of the water intake ramp 88. This prevents excessive volume of water to get through the inlet 86 into the water passage 87 and by so doing limits the increase of water pressure in the area of the inlet 86 and within the water intake ramp 88 that would occur but for the presence of the deflector 214. This also allows proper orientation of the flow of water flowing through the water intake ramp 88 in order to control the water pressure inside the inlet 86 and intake ramp 88.

In different embodiments of the invention, the specific shape of the deflector 214, including the specific curves of the bottom surface 217 and top surface 219 of the deflector 214, will define specific flow paths that optimise the impact of the deflector 214 on the control of water pressure in the water passage 87 considering the specific shape and configuration of the water jet propulsion system in which it is used, including the specific shape and configuration of the hull 12, inlet grate 200 and water passage 87, including the inlet 86, intake ramp 88, tunnel 94, venturi 100 and steering nozzle 102.

In the embodiment of the invention shown in FIG. 16, a top loader 215 is also used in combination with the deflector 214. Configuration and positioning of the top loader 215 in order to improve acceleration and high speed performances would be apparent for one skilled in the art. In the embodiment of the invention shown in FIG. 16, when the watercraft is in operation, traveling forward, a portion of water flowing from the front of the watercraft below the hull 12 will follow a second flow path defined by the top loader 215. This second flow path directs a portion of the water flowing below the inlet 86 at a distance from the deflector 214, into the inlet 86, therefore forcing a higher volume of water into the intake ramp 88, at a distance from the interior wall 89. The combined use of the deflector 214 and top loader 215 provides both acceleration performances and improved operational efficiency at high speed.

FIGS. 18 and 19 show an alternative embodiment of the invention where the watercraft is a sport boat 120 having two water jet propulsion systems 184*a* and 184*b* similar to the water jet propulsion system 84 described above unless otherwise indicated. Each water jet propulsion systems 184*a* and 184*b* has an inlet 86. The inlets 86 are disposed on opposite sides of a longitudinal axis of the sport boat 120. Since in a sport boat such as the sport boat 120 shown in FIGS. 6 and 7 the hull 12 has a V-shape structure, the inlet 84 define a plane at an angle with respect to horizontal. FIGS. 18 and 19 show that in such an embodiment of the invention, the first end 206 of the inlet grate 200 and the first plate 207 are on a different plane than the second end 208 of the inlet grate 200 and second plate 209, both planes defining an angle. As such the inlet grate 200 twists as it extends from the first end portion 206 to the second end portion 208.

FIG. 20 shows test results conducted using a BRP™ Speedster 200™ sport boat. Water pressure was measured was measured at three different areas of the water passage 87 of the water jet propulsion system, upstream of the jet pump. Those areas are identified by reference letters A, B and C in FIG. 13. Water pressure in those areas was measured when the watercraft reached a constant traveling speed of approximately 65 mph using pitot tubes disposed on the interior wall of each of those three areas according to pressure measurement techniques well known to those in the art. As is shown in FIG. 20, the addition of a deflector to the inlet grate significantly reduced water pressure in the area where water pressure was monitored. An improved handling of the watercraft was also observed.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. An inlet grate for a water jet propulsion system to be used in a watercraft, the water jet propulsion system having a water passage, the water passage having an inlet, the inlet having a forward area and a rearward area with respect to the watercraft, the inlet grate comprising:

a first end portion including a plate adapted to be connected to the forward area of the inlet, the plate being adapted to be disposed at least in part inside the water passage when the grate is installed on the jet propulsion system, the plate having a rearward end;

a second end portion adapted to be connected to the rearward area of the inlet;

at least one elongated member extending from the first end portion toward the second end portion; and at least one deflector having a forward end and a rearward end, the at least one deflector being in contact with the plate, the rearward end of the plate being spaced from the at least one deflector, the at least one deflector extending rearward and upward from the first end portion toward the second end portion, the at least one deflector being inclined relative to the elongated member such that at least a portion of a top surface and the rearward end of the at least one deflector are spaced from the plate in a direction perpendicular to the at least one elongated member, and the rearward end of the at least one deflector being disposed inside the water passage when the grate is installed on the jet propulsion system.

2. The inlet grate of claim 1, wherein the forward end of the at least one deflector is connected to the first end portion.

3. The inlet grate of claim 1, wherein the first end portion and the at least one deflector are integrally formed.

4. The inlet grate of claim 1, wherein the plate is a first plate and the second end portion includes a second plate adapted to be connected to the rearward area of the inlet.

5. The inlet grate of claim 1, wherein:

the at least one elongated member is at least two elongated members extending from the first end portion toward the second end portion; and the at least one deflector extends between at least two of the at least two elongated members.

6. The inlet grate of claim 5, wherein portions of sides of the at least one deflector are connected to the at least two elongated members.

7. The inlet grate of claim 1, wherein a first line extending from the first end portion to the second end portion defines an acute angle with a second line extending from the forward end of the at least one deflector to the rearward end of the at least one deflector.

8. The inlet grate of claim 7, wherein the acute angle is between 0° and 45°.

9. The inlet grate of claim 1, wherein the at least one elongated member extends from the first end portion to the second end portion.

10. The inlet grate of claim 1, wherein a position of the at least one deflector relative to the at least one elongated member is fixed.

11. The inlet grate of claim 1, further comprising a top loader connected to the at least one elongated member between the at least one deflector and the second end portion.

12. The inlet grate of claim 1, wherein the forward end of the at least one deflector is in contact with the plate.

13. A watercraft comprising:

a hull;

a deck disposed on the hull;

a water jet propulsion system connected to the hull and having a water passage, the water passage having an inlet, the inlet having a forward area and a rearward area, the water passage being defined at least in part by a wall extending upwardly and rearwardly from the forward area of the inlet;

an engine supported by the hull and adapted to drive the water jet propulsion system;

at least two elongated members extending from the forward area of the inlet toward the rearward area of the inlet;

a plate connected to the forward area of the inlet; and at least one deflector having a forward end and a rearward end, the at least one deflector being in contact with the plate, the at least one deflector extending rearward and upward from the forward area of the inlet toward the rearward area of the inlet, the at least one deflector being inclined relative to the inlet such that at least a portion of a top surface and the rearward end of the at least one deflector are spaced from the wall in a direction perpendicular to the at least two elongated members to form a gap between the wall and at least the portion of the top surface and the rearward end of the at least one deflector, a portion of the at least one deflector including at least the portion of the top surface and the rearward end of the at least one deflector extending between at least two of the at least two elongated members, the rearward end of the at least one deflector being disposed inside the water passage, and the at least one deflector being adapted to deflect a portion of water entering the water passage away from the wall.

14. A watercraft comprising:

a hull;

a deck disposed on the hull;

a water jet propulsion system connected to the hull and having a water passage, the water passage having an inlet, the inlet having a forward area and a rearward area, the water passage being defined at least in part by a wall extending upwardly and rearwardly from the forward area of the inlet;

an engine supported by the hull and adapted to drive the water jet propulsion system;

at least one elongated member extending from the forward area of the inlet toward the rearward area of the inlet; and at least one deflector having a forward end and a rearward end, the at least one deflector being in contact with the forward area of the inlet, the at least one deflector extending upward and rearward from the forward area of the inlet toward the rearward area of the inlet, the at least one deflector being inclined relative to the inlet such that at least a portion of a top surface and the rearward end of the at least one deflector are spaced from the wall in a direction perpendicular to the at least one elongated member, the rearward end of the at least one deflector being disposed inside the water passage, and the at least one deflector being adapted to deflect a portion of water entering the water passage away from the wall.

15. The watercraft of claim 14, wherein the forward end of the at least one deflector is connected to the forward area of the inlet.

16. The watercraft of claim 14, wherein:

the at least one elongated member is at least two elongated members extending from the forward area of the inlet toward the rearward area of the inlet; and the at least one deflector extends between at least two of the at least two elongated members.

17. The watercraft of claim 16, wherein portions of sides of the at least one deflector are connected to the at least two elongated members.

18. The watercraft of claim 14, wherein a first line extending from the forward area of the inlet to the rearward area defines an acute angle with a second line extending from the forward end of the at least one deflector to the rearward end of the at least one deflector.

19. The watercraft of claim 14, wherein a position of the at least one deflector relative to the at least one elongated member is fixed.

20. The watercraft of claim 14, wherein the forward end of the at least one deflector is in contact with the forward area of the inlet.

* * * * *